US008983318B2

(12) United States Patent
Omori et al.

(10) Patent No.: US 8,983,318 B2
(45) Date of Patent: Mar. 17, 2015

(54) IMAGE FORMING APPARATUS WITH A DENSITY SENSOR FOR DETECTING DENSITY FLUCTUATIONS

(71) Applicants: Atsufumi Omori, Kanagawa (JP); Masaaki Ishida, Kanagawa (JP); Kazuhiro Akatsu, Kanagawa (JP); Muneaki Iwata, Kanagawa (JP); Hayato Fujita, Kanagawa (JP)

(72) Inventors: Atsufumi Omori, Kanagawa (JP); Masaaki Ishida, Kanagawa (JP); Kazuhiro Akatsu, Kanagawa (JP); Muneaki Iwata, Kanagawa (JP); Hayato Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 97 days.

(21) Appl. No.: 13/843,147

(22) Filed: Mar. 15, 2013

(65) Prior Publication Data

US 2013/0243459 A1 Sep. 19, 2013

(30) Foreign Application Priority Data

Mar. 16, 2012 (JP) ..... 2012-061245
Mar. 16, 2012 (JP) ..... 2012-061246

(51) Int. Cl.
*G03G 15/00* (2006.01)

(52) U.S. Cl.
CPC ..... *G03G 15/556* (2013.01); *G03G 15/5058* (2013.01)
USPC ..... 399/49; 399/72

(58) Field of Classification Search
USPC ..... 399/49, 72, 301; 347/234, 236, 246, 347/248, 249, 251, 253; 358/504, 406
See application file for complete search history.

(56) References Cited

U.S. PATENT DOCUMENTS

| | | | | |
|---|---|---|---|---|
| 6,498,617 | B1 | 12/2002 | Ishida et al. | 347/252 |
| 6,731,317 | B2 | 5/2004 | Ema et al. | 347/135 |
| 6,791,596 | B2 | 9/2004 | Nihei et al. | 347/247 |
| 6,933,957 | B2 | 8/2005 | Omori et al. | 347/249 |
| 7,009,430 | B2 | 3/2006 | Nihei et al. | 327/141 |
| 7,256,815 | B2 | 8/2007 | Suzuki et al. | 347/249 |
| 7,271,824 | B2 | 9/2007 | Omori et al. | 347/249 |
| 7,463,278 | B2 | 12/2008 | Ozasa et al. | 347/249 |
| 7,496,121 | B2 | 2/2009 | Ishida et al. | 372/38.02 |
| 7,515,170 | B2 | 4/2009 | Omori et al. | 347/248 |
| 7,701,480 | B2 | 4/2010 | Omori et al. | 347/237 |
| 7,750,934 | B2 | 7/2010 | Yoshida | 347/246 |
| 7,826,110 | B2 | 11/2010 | Tanabe et al. | 358/509 |
| 7,903,135 | B2 | 3/2011 | Ichii et al. | 347/238 |
| 7,920,305 | B2 | 4/2011 | Ishida et al. | 358/481 |
| 7,936,367 | B2 | 5/2011 | Ishida et al. | 347/236 |
| 7,936,493 | B2 | 5/2011 | Ishida et al. | 359/204.1 |

(Continued)

FOREIGN PATENT DOCUMENTS

| | | |
|---|---|---|
| JP | 2003-127454 | 5/2003 |
| JP | 2007-135100 | 5/2007 |

(Continued)

*Primary Examiner* — Sophia S Chen
(74) *Attorney, Agent, or Firm* — Oblon, McClelland, Maier & Neustadt, L.L.P.

(57) ABSTRACT

An image forming apparatus is disclosed, including a light source; a drum; an optical scanning apparatus; and an endless belt. The image forming apparatus further includes a pattern forming unit which forms, on the endless belt along a conveying direction of the endless belt, a density fluctuation detecting pattern having a period; a density sensor which detects the density fluctuating detecting pattern and outputs a density signal including information on density fluctuations in the conveying direction of the endless belt; and a period detecting sensor which detects the period included in the density fluctuations.

20 Claims, 32 Drawing Sheets

(56) References Cited

U.S. PATENT DOCUMENTS

| | | | | |
|---|---|---|---|---|
| 7,995,251 | B2 | 8/2011 | Tanabe et al. | 358/482 |
| 8,072,667 | B2 | 12/2011 | Suzuki et al. | 359/205.1 |
| 8,089,665 | B2 | 1/2012 | Omori et al. | 358/480 |
| 8,207,996 | B2 | 6/2012 | Miyake et al. | 347/242 |
| 8,237,760 | B2 | 8/2012 | Nihei et al. | 347/237 |
| 8,253,768 | B2 | 8/2012 | Ishida et al. | 347/240 |
| 8,270,026 | B2 | 9/2012 | Nihei et al. | 358/1.7 |
| 8,310,513 | B2 | 11/2012 | Nihei et al. | 347/235 |
| 8,310,516 | B2 | 11/2012 | Tanabe et al. | 347/253 |
| 2007/0030548 | A1 | 2/2007 | Nihei et al. | 359/204 |
| 2007/0242127 | A1 | 10/2007 | Omori et al. | 347/248 |
| 2008/0291259 | A1 | 11/2008 | Nihei et al. | 347/236 |
| 2008/0298842 | A1 | 12/2008 | Ishida et al. | 399/221 |
| 2009/0195635 | A1 | 8/2009 | Ishida et al. | 347/243 |
| 2010/0119262 | A1 | 5/2010 | Omori et al. | 399/220 |
| 2011/0199657 | A1 | 8/2011 | Ishida et al. | 358/510 |
| 2011/0228037 | A1 | 9/2011 | Omori et al. | 347/247 |
| 2012/0099165 | A1 | 4/2012 | Omori et al. | 358/475 |
| 2012/0189328 | A1 | 7/2012 | Suzuki et al. | 399/32 |
| 2012/0201552 | A1* | 8/2012 | Hirai et al. | 399/49 |
| 2012/0274986 | A1* | 11/2012 | Harashima et al. | 358/3.21 |
| 2012/0293783 | A1 | 11/2012 | Ishida et al. | 355/67 |
| 2013/0243457 | A1* | 9/2013 | Kaneko et al. | 399/49 |

FOREIGN PATENT DOCUMENTS

| | | |
|---|---|---|
| JP | 2008-065270 | 3/2008 |
| JP | 2009-262344 | 11/2009 |

* cited by examiner

PRIOR ART

FOR CIRCLE

FOR LOW CIRCULARITY

IMAGE FORMING APPARATUS WITH A DENSITY SENSOR FOR DETECTING DENSITY FLUCTUATIONS

TECHNICAL FIELD

The present invention relates to image forming apparatuses which form an image onto a medium such as paper, etc.

BACKGROUND ART

An image forming apparatus represented by a laser beam printer is known, wherein a light beam emitted from a light source is deflected and scanned in a main scanning direction by a deflecting and scanning unit, and is collected toward a drum (a photosensitive body) which has a face to be scanned, and a latent image is formed on a drum surface. In such an image forming apparatus, the latent image on the drum surface is transferred onto an intermediate transfer belt which is placed between the drum and a developing roller and an image which corresponds to the latent image is formed onto the intermediate transfer belt.

In the image which is formed onto the intermediate transfer belt, density fluctuations may occur in a main scanning direction and a sub-scanning direction, respectively. One possible cause of the density fluctuations is process gap (PG) fluctuations. First, the density fluctuations of the image in the main scanning direction are considered. As a factor for this, parallel characteristics of the drum (the photosensitive body) and the developing roller are possible. For example, when the mutual parallel characteristics of the drum and the developing roller are lost, variations occur in capabilities of developing onto the drum, possibly causing density fluctuations with respect to the main scanning direction. Here, the density fluctuations linearly change in the main scanning direction.

Next, the density fluctuations of the image in the sub-scanning direction are considered. One factor for this may be decentering of the drum. For example, when a slight movement of an axle of the drum occurs, positions at which a distance from a rotational axle of the drum to a surface differs occur, so that positions occur in which there is a difference in a gap between the drum and the developing roller. This difference in the gap becomes a developing variation, which would affect the image as the density fluctuations in the sub-scanning direction.

A different factor may be circularity of the drum. For example, assume that there is a second drum with low circularity relative to a first drum, which is circular. Then, with the second drum, at a time of rotation thereof, a difference occurs in a gap between the drum and the developing roller depending on a rotational angle, which may become a factor for fluctuations in developing. Due to the above-described factors, density fluctuations in the sub-scanning direction occur for an image formed on the drum surface. These density fluctuations become periodic, which occurs with a rotational period of the drum.

Factors for the density fluctuations include other factors such as potential variations of the drum, toner supply, toner removal, discharging, cleaning, etc., so that, combining them with density fluctuations due to process gap fluctuations, causes dynamic fluctuations to occur in both the main scanning direction and the sub-scanning direction.

In order to reduce such density fluctuations, for example, a light amount adjustment is performed in accordance with a transmitting characteristic of optics in the main scanning direction, for example. Moreover, for correcting in the sub-scanning direction, there is known a technique in which, for example, correction data are created in accordance with sensitivity variations of a photosensitive body to change a light amount in the sub-scanning direction, and a failure due to a phase offset of a rotational period of the photosensitive body and the correction data is avoided by an arithmetic calculation.

RELATED-ART DOCUMENTS

Patent Documents

Patent document 1: JP2008-065270A

Patent document 2: JP2003-127454A

However, besides the transmitting characteristics of the optics, there are density fluctuation producing factors in the main scanning direction, so that density fluctuations may occur in the main scanning direction over time. Moreover, there are also multiple density fluctuation producing factors in the sub-scanning direction, so that complex density fluctuations may occur by a combination thereof. With the above-described technique, a dynamic range of the density correction is narrow, so that it is difficult to realize a highly accurate density correction.

DISCLOSURE OF THE INVENTION

In light of the problems described above, an object of the present invention is to provide an image forming apparatus which makes it possible to improve a dynamic range of density correction and realize a highly accurate density correction.

According to an embodiment of the present invention, an image forming apparatus is provided. The image forming apparatus includes a light source; a drum which is a photosensitive body; an optical scanning apparatus which deflects and scans, in a main scanning direction by a deflecting and scanning unit, a light beam emitted from the light source, and collects, by a scanning and image forming unit, the deflected and scanned light beam on the drum, which drum has a face to be scanned, to form a latent image onto a surface of the drum; and an endless belt which is arranged to be in contact with the drum and on which an image corresponding to the latent image is formed, the image forming apparatus further including a pattern forming unit which forms, on the endless belt along a conveying direction of the endless belt, a density fluctuation detecting pattern having a period; a density sensor which detects the density fluctuating detecting pattern and outputs a density signal including information on density fluctuations in the conveying direction of the endless belt; and a period detecting sensor which detects the period included in the density fluctuations.

The disclosed technique makes it possible to provide an image forming apparatus which improves a dynamic range of density correction and which can realize a highly accurate density correction.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

A description is given below with regard to embodiments of the present invention with reference to the drawings. In the respective drawings, the same numbers are applied to the same elements, so that duplicate explanations may be omitted.

First Embodiment

Figure 1A:
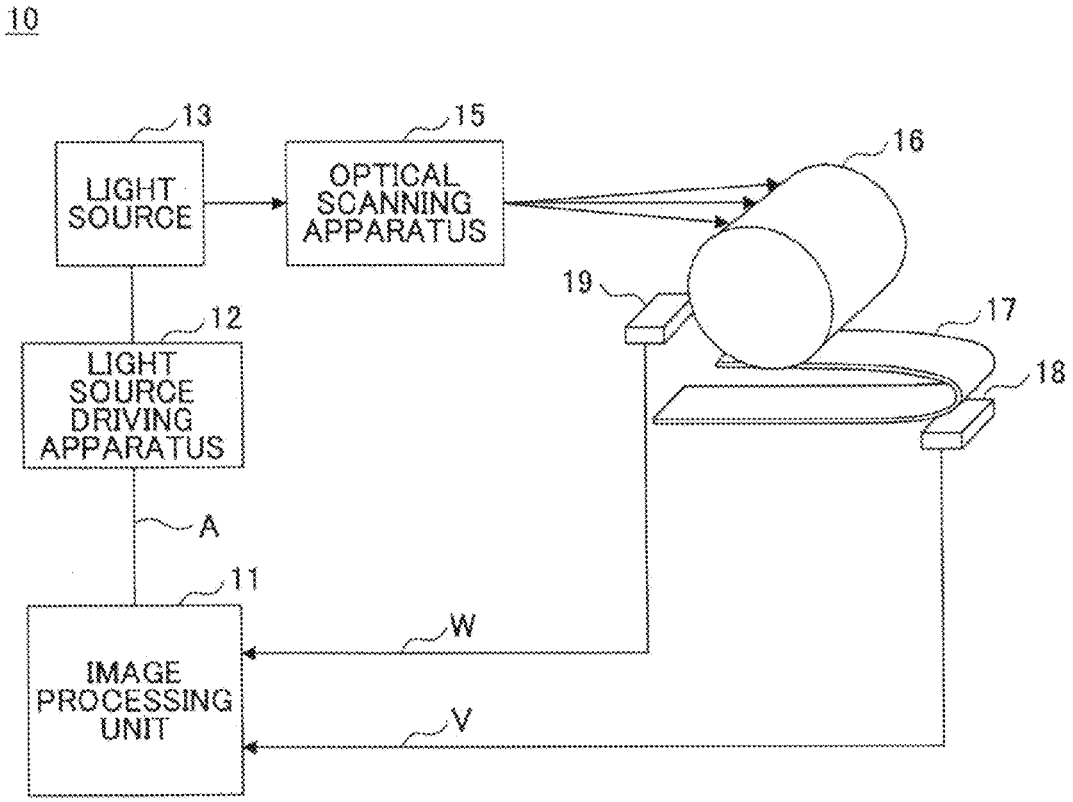
FIG. 1A is a schematic diagram exemplifying an image forming apparatus according to a first embodiment.

FIG. 1A is a schematic diagram exemplifying an image forming apparatus according to a first embodiment. With reference to FIG. 1A, the image forming apparatus 10 includes an image processing unit 11; a light source driving apparatus 12; a light source 13; an optical scanning apparatus 15; a drum 16; an intermediate transfer belt 17; a density sensor 18; and a home position sensor 19 (which may be called an HP sensor 19 below).

In the image forming apparatus 10, the density sensor 18 reads a density of a toner pattern formed onto the intermediate transfer belt 17, and outputs, to the image processing unit 11, a density signal V, which is an output signal in which an affixed amount of toner is converted to a voltage. For example, the density sensor 18 may be arranged such that a light emitted by an LED is irradiated onto the intermediate transfer belt 17 and a specularly reflected light and a diffuse reflected light which are obtained in accordance with a toner density on the intermediate transfer belt 17 is detected by a light receiving element.

The HP sensor 19, which is a period detecting sensor which detects a rotational period of the drum 16, outputs a home position signal W (which may be called an HP signal W below) to the image processing unit 11. As described below, the image forming apparatus 10 may include multiple density sensors and multiple HP sensors.

The image processing unit 11 includes a CPU, a ROM, a RAM, a main memory, etc., for example, various functions of which image processing unit 11 may be realized by a program recorded in the ROM, etc., being read into the main memory to be executed by the CPU. A part or the whole of the image processing unit 11 may be realized by hardware only. Moreover, the image processing unit 11 may physically be configured with multiple apparatuses.

The image processing unit 11 detects density fluctuations based on an HP signal W and a density signal V input, calculates a light amount correction amount which corrects for the density fluctuations in the main scanning direction and the sub-scanning direction to generate and output, to the light source driving apparatus 12, a light amount control signal A. The light source driving unit 12 drives the light source 13 based on the light amount control signal A.

As the light source 13, a semiconductor laser, etc., may be used, for example. As a semiconductor laser, a VCSEL (Vertical Cavity Surface Emitting LASER), etc., may be used, for example.

A light beam emitted from the light source 13 is transmitted toward the drum 16, which is a photosensitive body by the optical scanning apparatus 15, and a latent image is formed onto a surface of the drum 16. The optical scanning apparatus 15 includes, for example, a deflecting and scanning unit (not shown) which deflects and scans, in a main scanning direction, a light beam emitted from the light source 13; a scanning and image forming unit (not shown) which collects the deflected and scanned light beam onto the drum 16, which is a face to be scanned, etc.

Then, after undergoing processes of developing and transferring, toner whose amount is based on a light emitting amount and a light emitting time of the light source 13 is affixed onto the intermediate transfer belt 17 and a predetermined image is formed. The intermediate transfer belt 17 is an endless belt which is arranged to be in contact with the drum 16 and onto which an image corresponding to the latent image is formed.

In this way, in the image forming apparatus 10, light emitting level control of the light source 13 is performed with a light amount based on a light amount control signal A which corrects for density fluctuations in the main scanning direction and the sub-scanning direction. In this way, the respective density fluctuations in the main scanning direction and the sub-scanning direction may be decreased by control of a light amount of the light source 13.

The light amount control signal A based on only density fluctuations in either one of the main scanning direction and the sub-scanning direction can also be generated to correct for only density fluctuations in the one of the main scanning direction and the sub-scanning direction. The main scanning direction is a direction which is orthogonal to a conveying direction of the intermediate transfer belt 17, while the sub-scanning direction is the conveying direction of the intermediate transfer belt 17.

Figure 1C:
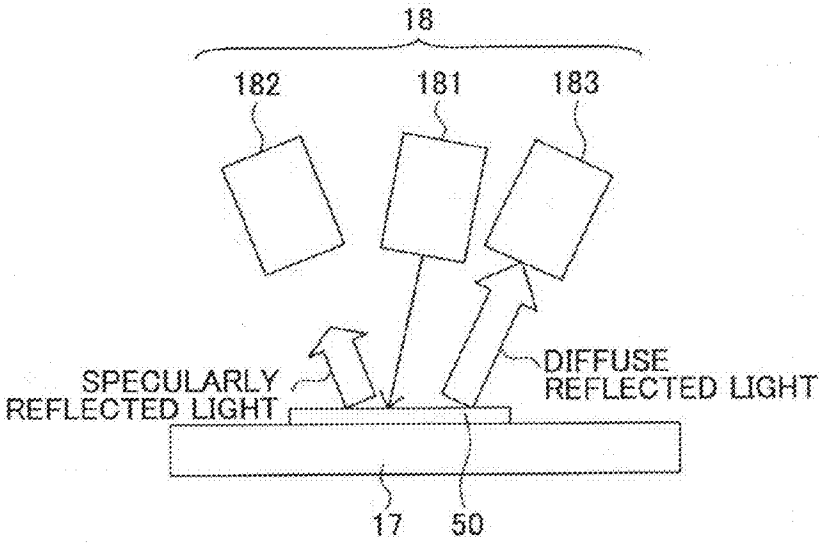
FIGS. 1B and 1C are schematic diagrams exemplifying a density sensor.
Figure 1B:
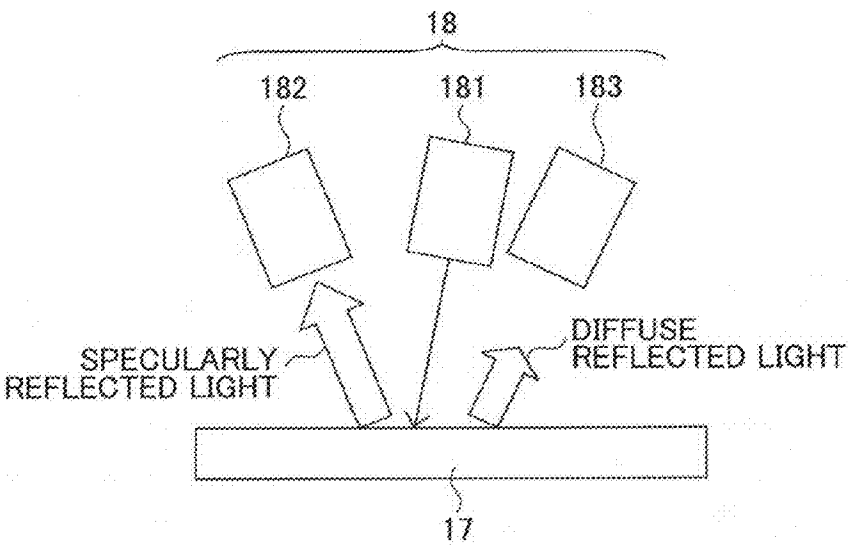

Below main constituting elements of the image forming apparatus 10 are described in more detail. FIGS. 1B and 1C are schematic diagrams exemplifying a density sensor. FIG. 1B shows a case in which the toner is not affixed onto the intermediate transfer belt 17, while FIG. 1C shows a case in which the toner is affixed onto the intermediate transfer belt 17.

With reference to FIGS. 1B and 1C, the density sensor 18 includes a light-emitting element 181; the specularly reflected light receiving element 182; and the diffuse reflected light receiving element 183. The light emitting element 181 is a light emitting diode (LED), for example, while the specularly reflected light receiving element 182 and the diffuse reflected light receiving element 183 are photodiodes (PDs), for example.

As shown in FIG. 1B, when the toner is not affixed onto the intermediate transfer belt 17, a larger amount of light irradiated from the light emitting element 181 is represented by a light which is specularly reflected from the intermediate transfer belt 17, and a larger amount of light is incident onto the specularly reflected light receiving element 182. On the other hand, an amount of diffuse reflected light on the intermediate transfer belt 17 is small, so that almost no light is incident onto the diffuse reflected light receiving element 183.

When the toner 50 is affixed onto the intermediate transfer belt 17 as shown in FIG. 1C, an amount of the specularly reflected light becomes smaller, and an output signal of the specularly reflected light receiving element 182 becomes smaller. On the other hand, an amount of diffuse reflected light becomes larger, and an output signal of the diffuse reflected light receiving element 183 becomes larger.

In this way, for a case in which the toner 50 is not affixed and for a case in which the toner 50 is affixed, detected signal levels of the respective specularly reflected light receiving element 182 and diffuse reflected light receiving element 183 differ. This makes it possible to detect a density of the toner 50 on the intermediate transfer belt 17. How the detected signal levels of the respective specularly reflected receiving element 182 and the diffuse reflected light receiving element 183 correspond to an actual image density cannot be discriminated only from the above-described configurations. This will be described below with reference to FIGS. 4A and 4B.

Figure 2A:
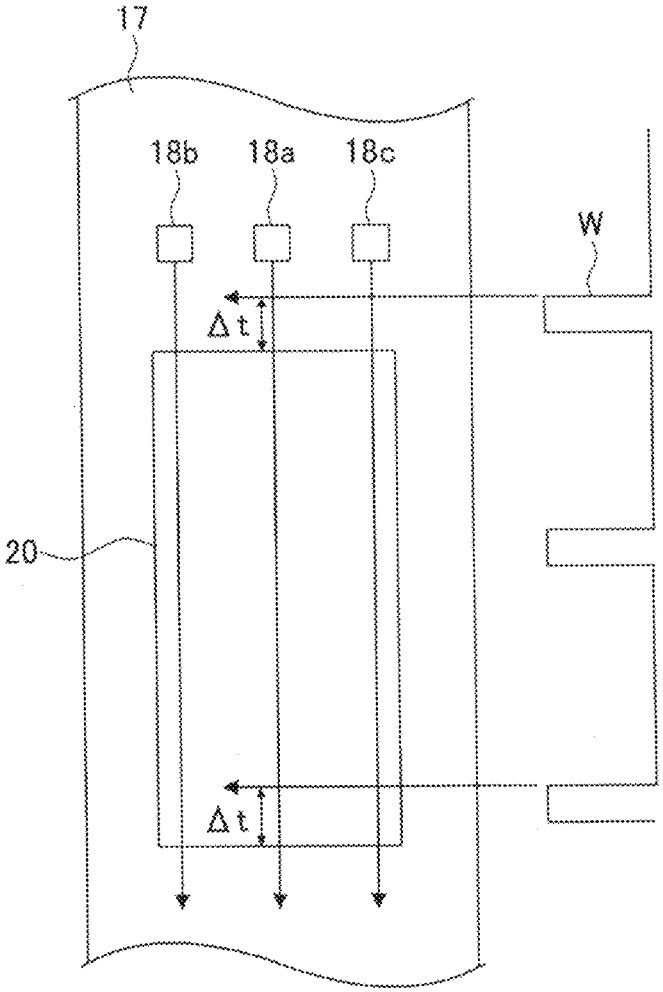
FIG. 2A is a diagram for describing a density fluctuation detecting pattern.

FIG. 2A is a diagram for describing a density fluctuation detecting pattern. As shown in FIG. 2A, according to the present embodiment, a density fluctuation detecting pattern 20 for detecting density fluctuations is formed on the intermediate transfer belt 17 in synchronicity with an HP signal W which is detected with a rotation of the drum 16. The density fluctuation detecting pattern 20 can be formed from a time which is delayed by Δt, for example, relative to the HP signal W to accurately detect density fluctuations at a specific location of the drum 16 by density sensors 18*a*, 18*b*, and 18*c*. Moreover, with the HP signal W as a trigger signal, a density signal which indicates density fluctuations can be repeatedly detected from the density fluctuation detecting pattern 20 by the density sensors 18*a*, 18*b*, and 18*c* to obtain a more accurate density signal.

Figure 2B:
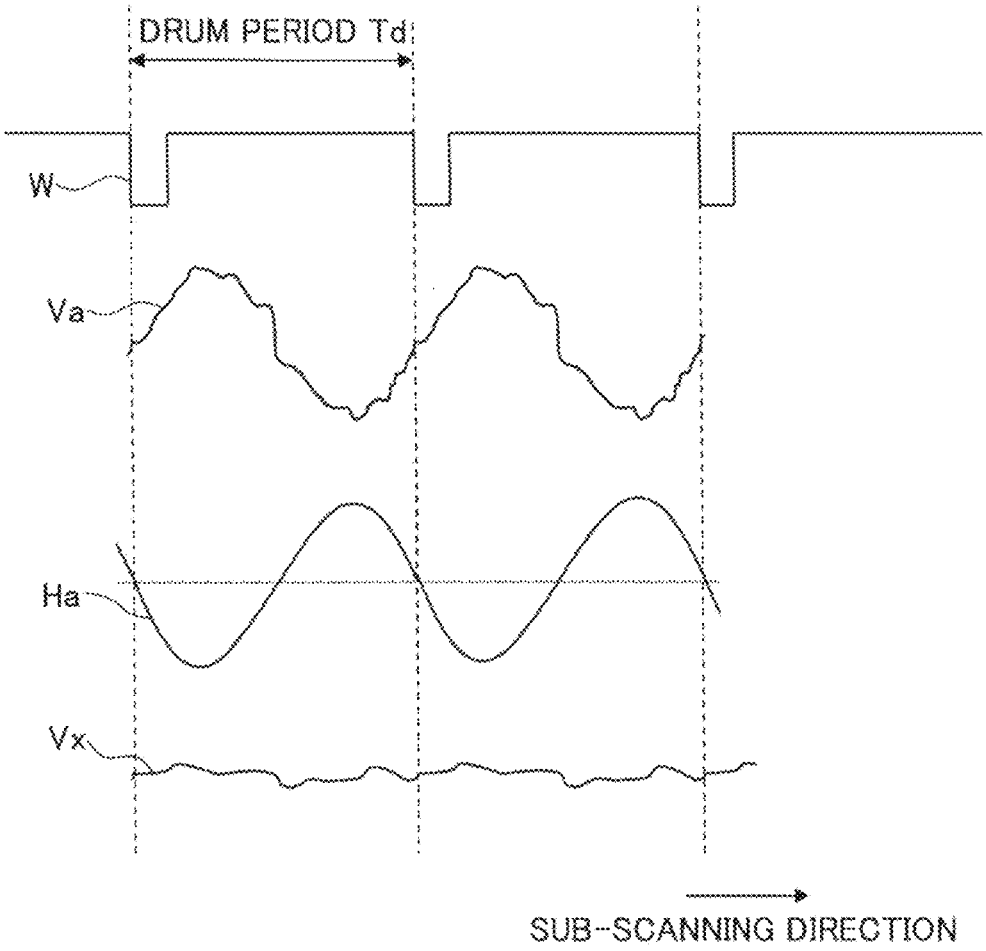
FIG. 2B is a diagram for describing a method of density correction in a sub-scanning direction.

FIG. 2B is a diagram for describing a method of density correction in the sub-scanning direction. With the HP signal W as a trigger signal, a density signal which indicates density fluctuations may be detected from the density fluctuation detecting pattern 20 by the density sensors 18*a*, 18*b*, and 18*c*. For example, a density signal Va with the same period as a period Td of the drum 16 may be detected from the density sensor 18*a*.

Moreover, based on the density signal Va, as a correction signal Ha, a sinusoidal signal with a phase which is reverse that of the density signal Va and the same period as the period Td of the drum 16 may be generated. By controlling a light amount signal of the light source 13 using a correction signal Ha with a phase which is reverse that of the density signal Va, the density fluctuation detecting pattern can be formed to reduce density fluctuations of the formed density fluctuation detecting pattern in the sub-scanning direction, for example, see density signal Vx.

In other words, when the density fluctuation detecting pattern which is corrected for using the correction signal Ha is detected by the density sensor 18*a*, for example, a signal whose amplitude is smaller than that of the density signal Va is obtained. In lieu of the density signal Va, which is an output signal of the density sensor 18*a*, a correction signal may be generated based on an output signal of the density sensor 18*b* or 18*c* to reduce the density fluctuations in the sub-scanning direction. Moreover, a correction signal may be generated based on an average value of output signals of the density sensors 18*a* to 18*c* to reduce the density fluctuations in the sub-scanning direction.

In this way, a correction signal Ha which corrects for density fluctuations in the sub-scanning direction which is orthogonal to the main scanning direction may be generated based on an output signal of the HP sensor 19 and an output signal of at least one density sensor of multiple density sensors 18*a*, 18*b*, and 18*c* which are arranged in parallel in the main scanning direction. Then, light emitting level control of the light source 13 may be performed with a light amount based on the correction signal Ha to reduce density fluctuations in the sub-scanning direction. The correction signal Ha does not have to be a sinusoidal periodic pattern, and may be set to be a triangular periodic pattern, a trapezoidal periodic pattern, etc., for example, in accordance with conditions.

Figure 3A:
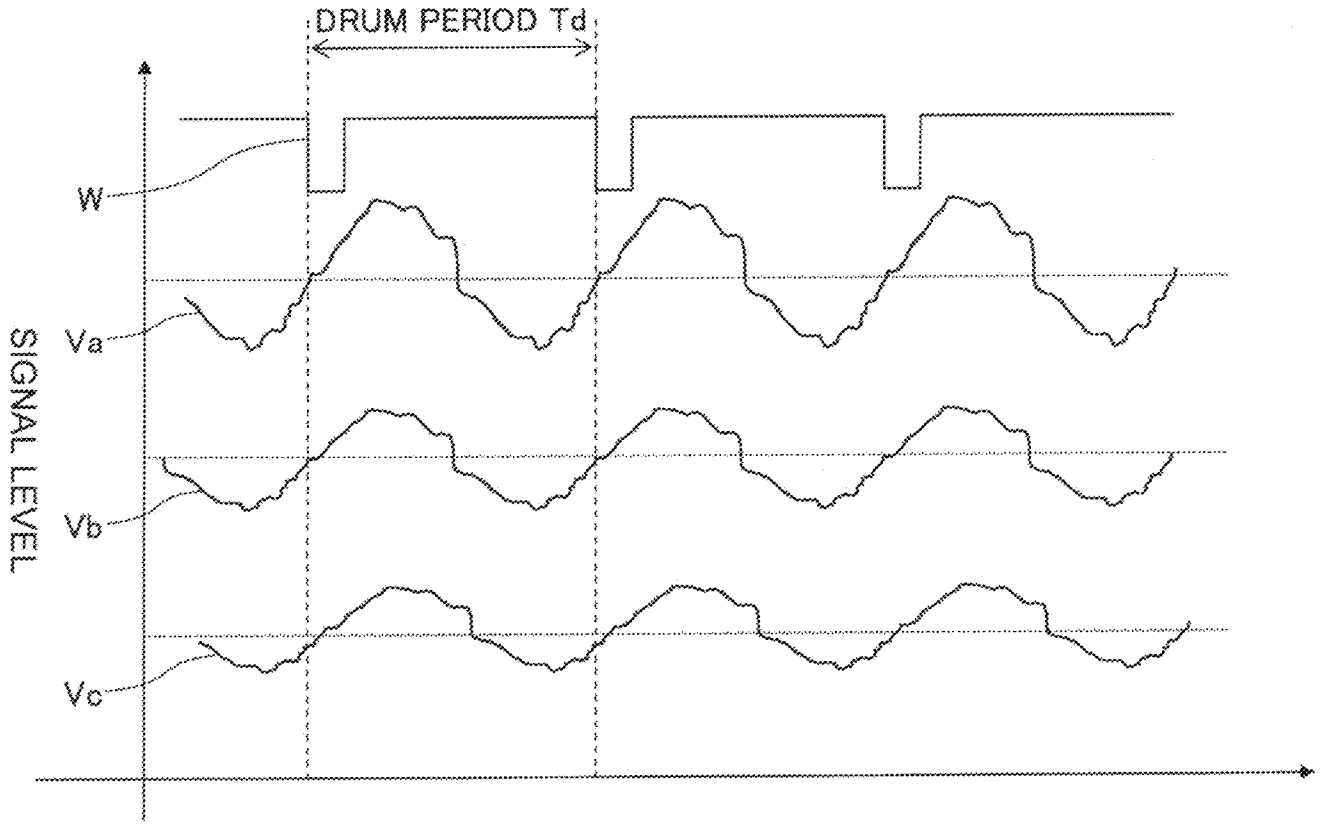
FIG. 3A is a diagram illustrating a first part of a diagram for describing the method of density correction in a main scanning direction.

FIG. 3A is a diagram for describing a density correcting method in the main scanning direction. As shown in FIG. 2A as described above, when multiple density sensors (three density sensors 18*a*, 18*b*, and 18*c* in this case) which are lined up in the main scanning direction are used to detect the density fluctuation detecting pattern 20, in addition to the above-described periodic fluctuations in the sub-scanning direction, density signals Va, Vb, and Vc with differing signal levels are obtained in the main scanning direction as shown in FIG. 3A.

Figure 3B:
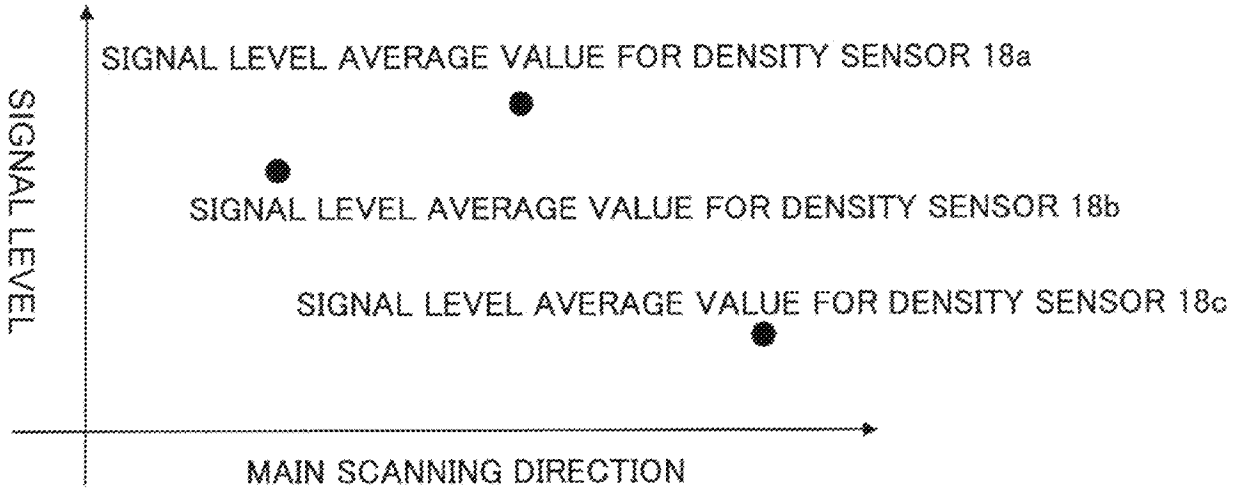
FIG. 3B is a diagram illustrating a second part of the diagram for describing the method of density correction in the main scanning direction.
Figure 3C:
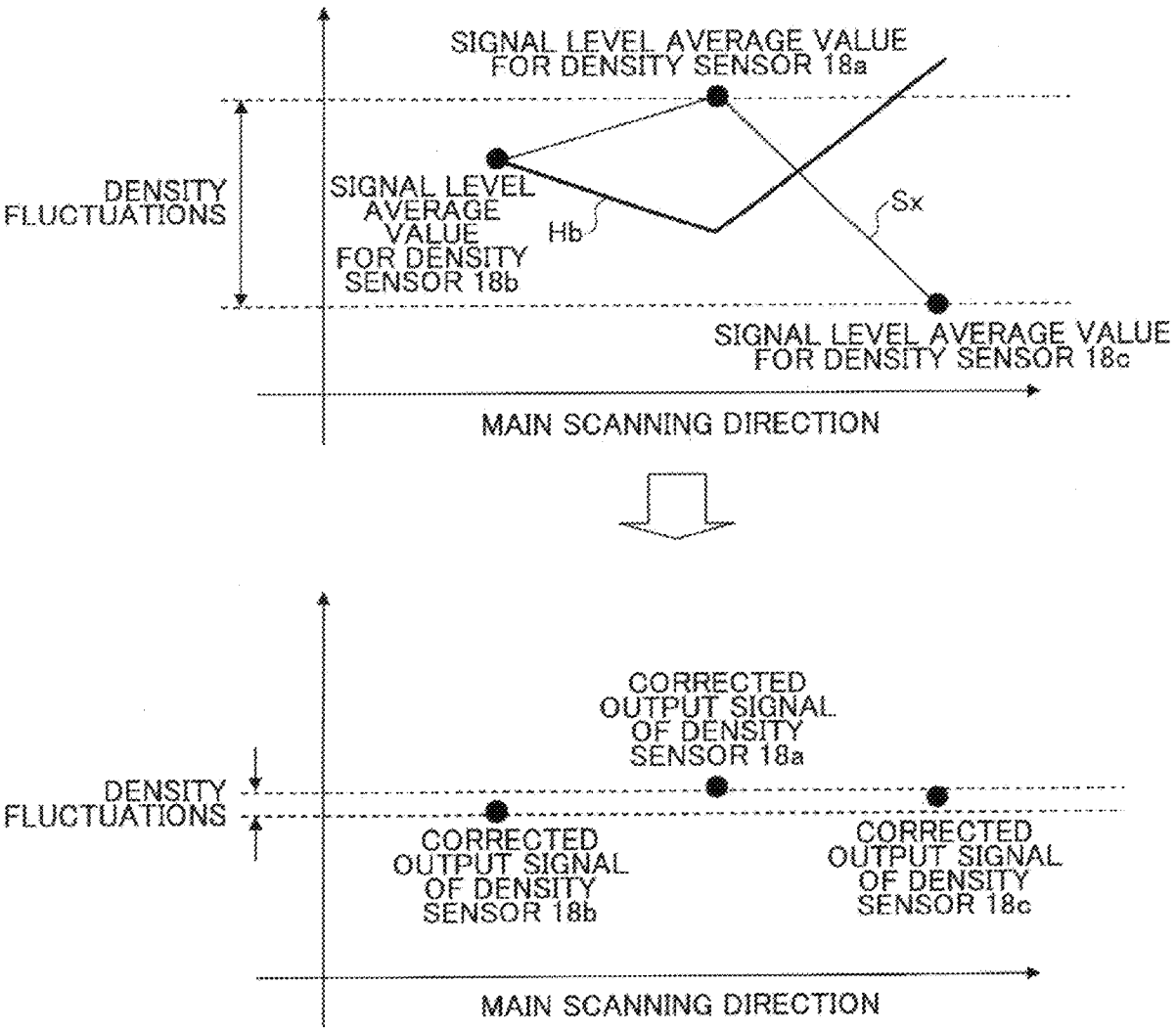
FIG. 3C is a diagram illustrating a third part of the diagram for describing the method of density correction in the main scanning direction.

Based on the HP signal W, the density signals Va, Vb, and Vc may be sampled for one period or for multiple periods to detect density fluctuations in the main scanning direction as shown in FIG. 3B. As shown in FIG. 3C, density fluctuations in the main scanning direction can be reduced by linearly interpolating density signals Va, Vb, and Vc to generate the interpolated signal Sx, reversing the interpolated signal Sx to generate a correction signal Hb, and controlling a light amount signal of the light source 13 using the correction signal Hb.

While the above explanations have been given by breaking down into the sub-scanning direction and the main scanning direction for convenience, in practice, the correction signal Ha in the sub-scanning direction and the correction signal Hb in the main scanning direction are independently generated, and a light amount control signal A (see FIG. 1A) in which the correction signal Ha and the correction signal Hb are convolved is generated to drive the light source 13. In this way, the respective density fluctuations in the main scanning direction and the sub-scanning direction may be reduced by control of a light amount of the light source 13.

Figure 4A:
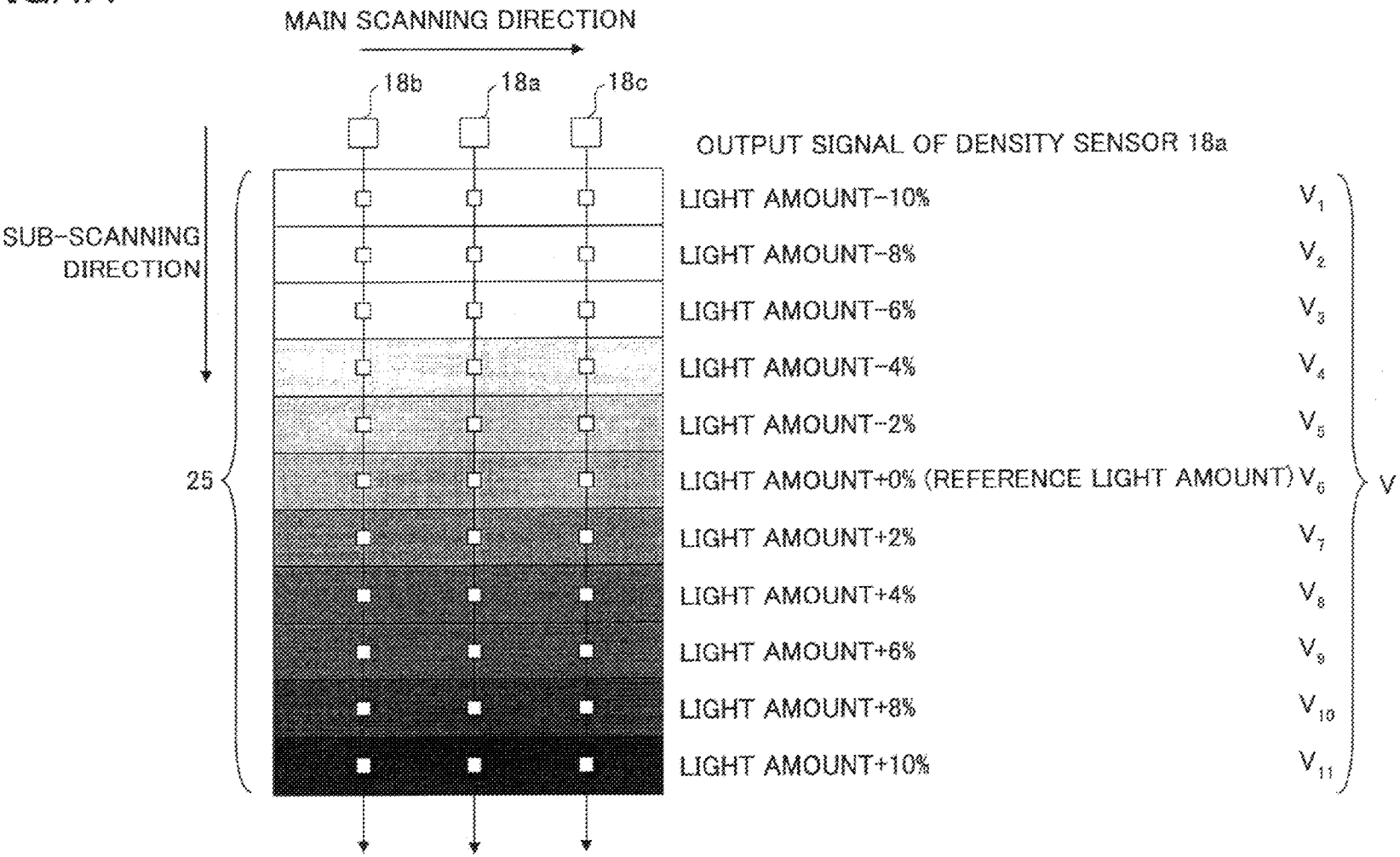
FIG. 4A is a diagram illustrating a first part of a diagram for describing density calibration.
Figure 4B:
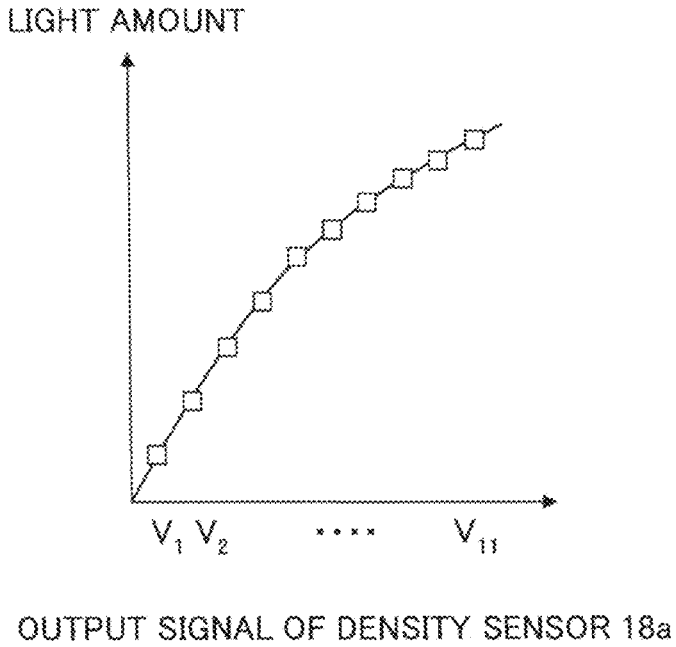
FIG. 4B is a diagram illustrating a second part of the diagram for describing density calibration.

FIGS. 4A and 4B are drawings for describing density calibration. In order to perform density correction, it is necessary to know a fluctuating amount of density relative to light amount fluctuations. As shown in FIG. 4A, a case is considered of successively increasing an amount of light which forms a pattern by control of an exposure power of the light source 13, drawing a density calibrating pattern 25 which has 11 levels (11 types) of rectangular-shaped patterns with differing densities in the sub-scanning direction, and detecting, by the density sensor 18*a* on the sub-scanning line, density signal V (including $V_1$ to $V_{11}$) which correspond to the respective patterns which make up the density calibrating pattern 25. FIG. 4A shows that a light amount is caused to be changed in intervals of 2% from −10% to +10% relative to a reference light amount.

Then, between the respective patterns which make up the density calibrating pattern 25 and the light amount increased for changing the density, there is a generally linear relationship. Moreover, there is also a generally linear relationship between the density of the respective patterns which make up the density calibrating pattern 25 and the density signal V (including $V_1$ to $V_{11}$), a generally linear relational data between the light amount and the density signal V (including $V_1$ to $V_{11}$) may be obtained as shown in FIG. 4B.

Furthermore, an actual print may be performed to measure an image density with a colorimeter, a scanner, etc., and a correspondence thereof with the density signal V (including $V_1$ to $V_{11}$) may be made to take a correlation between an actual image density and the density signal V (including $V_1$ to $V_{11}$). Similarly, for the density sensors 18*b* and 18*c*, a correlation may be taken between the actual image density and the density signal.

While an example is shown in FIG. 4A of forming the density calibrating pattern 25 with 11 levels of exposure power that are changed by controlling exposure power of the light source 13, the density calibrating pattern 25 may be formed with at least 3 levels of exposure power that are changed by controlling exposure power of the light source 13 to calculate a change amount of the density relative to light amount fluctuations of the light source 13.

Figure 5:
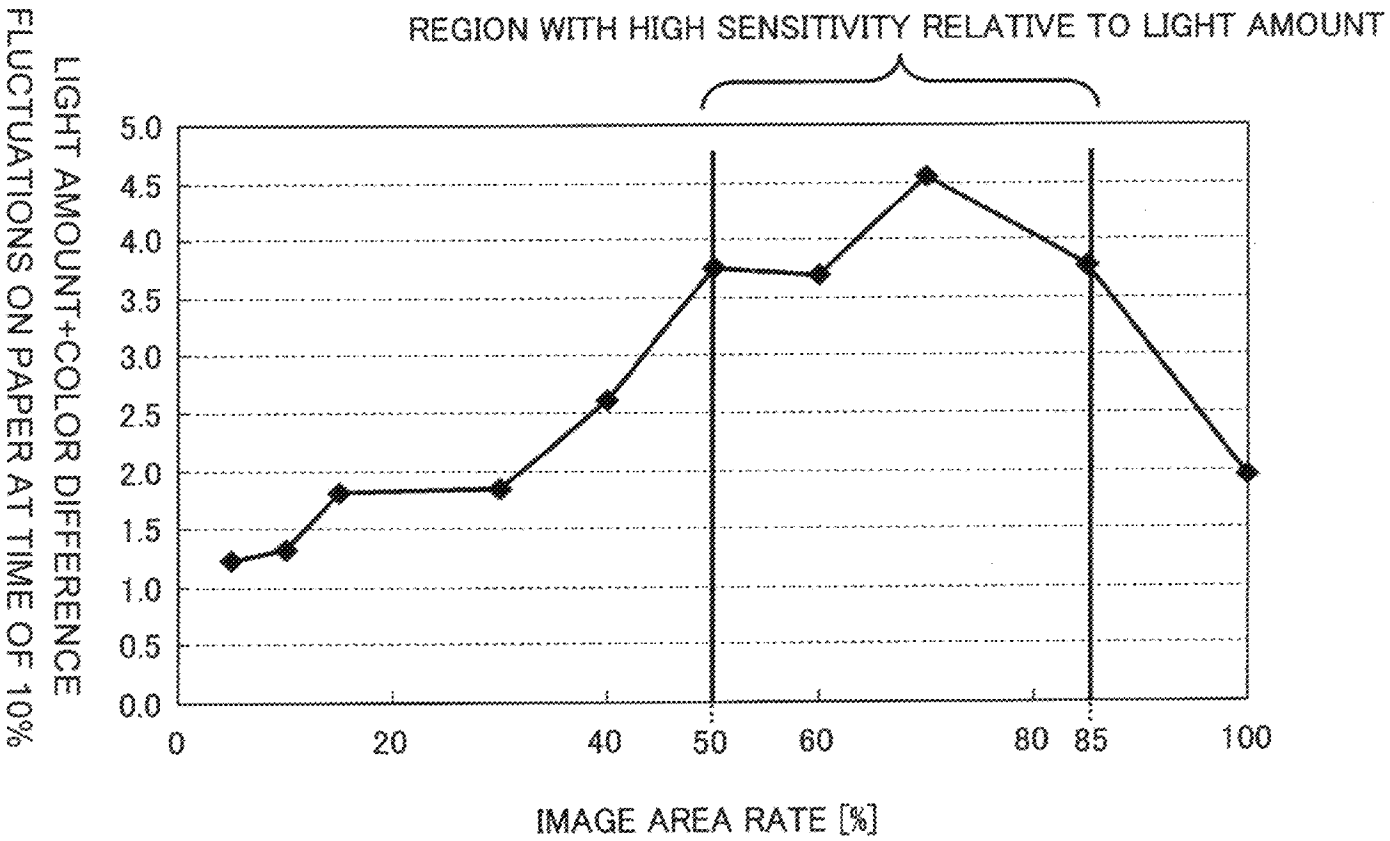
FIG. 5 is a diagram exemplifying a relationship between an image area rate and color difference fluctuations.

In the present embodiment, the image area rates of the density fluctuation detecting pattern 20 shown in FIG. 2A and the density calibrating pattern 25 shown in FIG. 4A are respectively set between 50% and 85%. When correcting for density fluctuations within a page, correction can be performed favorably by changing a color difference in increments of 0.2 from a point of sensing by a density sensor or visual inspection. When the image area rate is between 50% and 85%, color difference fluctuations on paper becomes approximately 4 when the light amount is changed +10% as shown in FIG. 5. Therefore, in order to change the color difference in increments of 0.2, it suffices that a light amount control resolution be ±0.5%.

On the other hand, when the image area rate is other than between 50% and 85%, in order to change the color difference in increments of 0.2, the light amount control resolution becomes approximately ±1%, so that a dynamic range of density correction becomes narrow when taking into account upper and lower limits of a light amount change. The image area rate is a numerical value which indicates how much of a basic matrix of a dot or a parallel line is occupied when outputting a certain density pattern, and may also be called a dot area rate. For example, for a checker-shaped density pattern, the image area rate becomes 50%. The image area rate on paper may be calculated by calculating backwards from a CCD or a spectroscope.

In this way, setting the image area rate of the density fluctuation detecting pattern 20 between 50% to 85% causes a dynamic range of density correction to be wide, so that accurate density fluctuation data for density correction can be obtained for density fluctuations caused by the drum 16, making it possible to realize an image forming apparatus 10 which can reduce density fluctuations in a simple configuration. The same applies also to the density calibrating pattern 25.

Figure 6:
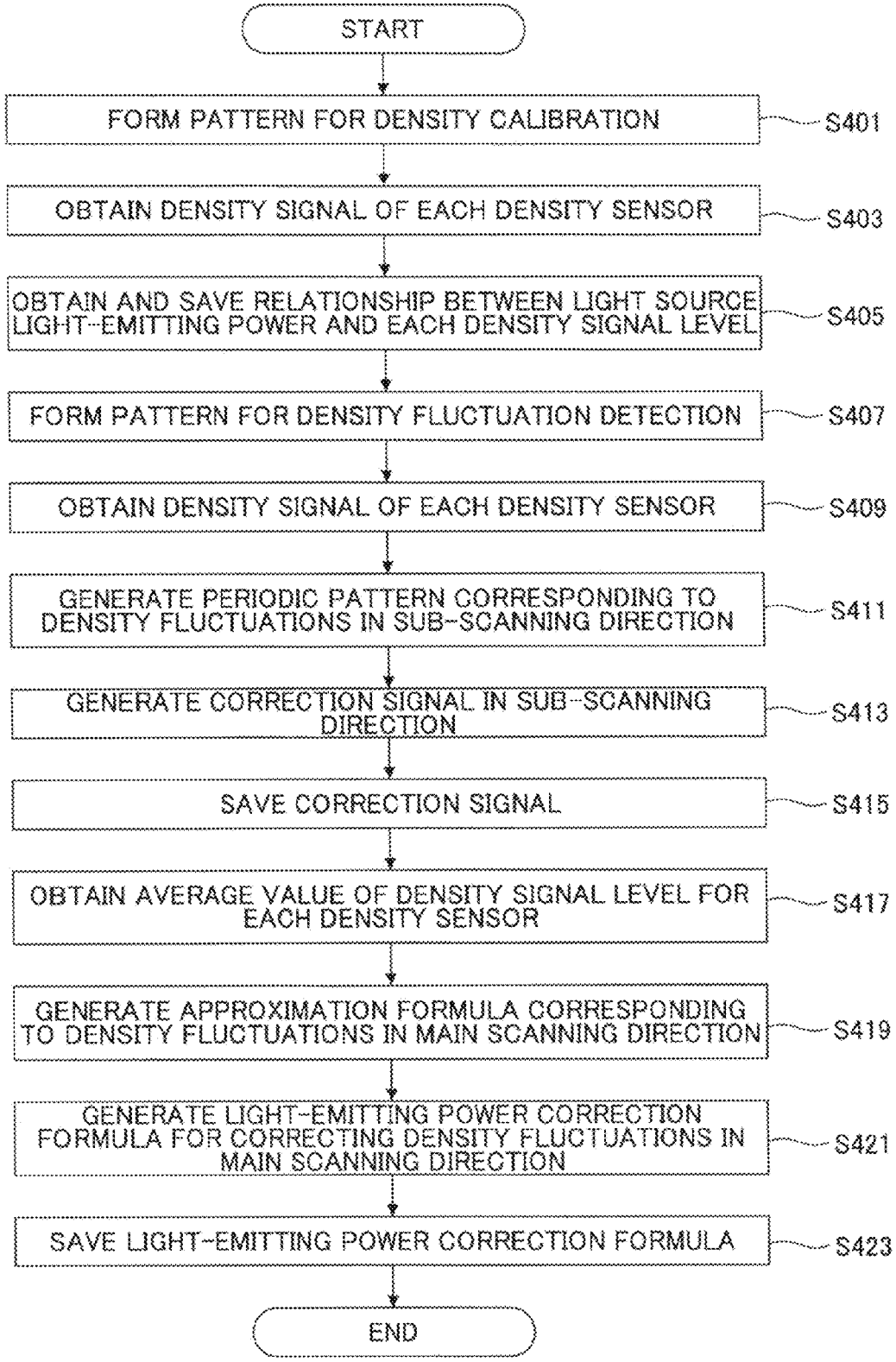
FIG. 6 is a diagram illustrating one example of a flowchart on density fluctuation correction according to the first embodiment.
Figure 7:
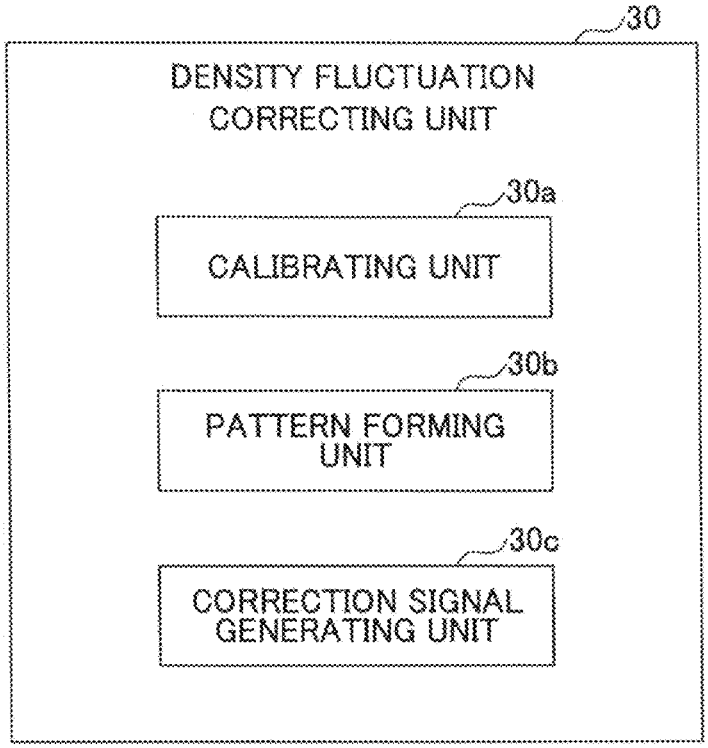
FIG. 7 is a functional block diagram exemplifying a density fluctuation correcting unit according to the first embodiment.

Here, density fluctuation correction is described in further detail below with reference to FIGS. 6 and 7. FIG. 6 is an example of a flowchart on density fluctuation correction according to the first embodiment. FIG. 7 is a functional block diagram exemplifying a density fluctuation correcting unit according to the first embodiment. A calibrating unit 30*a*, a pattern forming unit 30*b*, and a correcting signal generating unit 30*c* of the density fluctuation correcting unit 30 shown in FIG. 7 may be realized by the image processing unit 11, the light source driving apparatus 12, the light source 13, the optical scanning apparatus 15, etc.

With reference to FIGS. 6 and 7, first in step S401, the calibrating unit 30*a* forms a density calibrating pattern as shown in FIG. 4, for example, at a position corresponding to the density sensors 18*a*, 18*b*, and 18*c* on the intermediate transfer belt 17. Then, the calibrating unit 30*a* forms a uniform density calibrating pattern with at least three levels (11 levels in the example in FIG. 4A) of exposure power that are changed by control of exposure power in the light source 13 and with the image area rate between 50% and 85%. Next, in step S403, the calibrating unit 30*a* obtains a density signal of the respective density sensors 18*a*, 18*b*, and 18*c* which correspond to the density calibrating pattern 25.

Next, in step S405, the calibrating unit 30*a* obtains correlation data between the respective density signal levels and light emitting power (light amount) of the light source 13 as shown in FIG. 4B, for example, and saves it in a memory, etc. In this way, correlation is taken between the density calibrating pattern 25 and the respective density signals obtained from the density sensors 18*a*, 18*b*, and 18*c*. In other words, a correspondence between amplitude of the density signals and a density of an image formed onto the intermediate transfer belt is identified, making it possible to discriminate a magnitude of the density relative to the density signal (the density is calibrated).

Next, in step S407, the pattern forming unit 30*b* forms a density fluctuation detecting pattern 20 as shown in FIG. 2A, for example, at a position which corresponds to the density sensors 18*a*, 18*b*, and 18*c* that are on the intermediate transfer belt 17 with a rotational period of the drum 16 that is detected by the HP sensor 19. Then, the pattern forming unit 30*b* forms a uniform density fluctuation detecting pattern 20 with an image area rate between 50% and 85%.

Next, in step S409, the correction signal generating unit 30*c* obtains the respective density signals (density signals Va, Vb, and Vc, which are indicated in FIG. 3A) of the density sensors 18*a*, 18*b*, and 18*c* that correspond to the density fluctuation detecting pattern 20. Next, in step S411, the correction signal generating signal 30*c* generates a periodic pattern corresponding to density fluctuations in the sub-scanning direction. The periodic pattern corresponding to the density fluctuation in the sub-scanning direction may be obtained by approximating a signal in which density signals Va, Vb, Vc shown in FIG. 3A are averaged with a sinusoidal wave. Alternatively, the periodic pattern corresponding to the density fluctuations in the sub-scanning direction may be obtained by approximating, with a sinusoidal wave, an output signal of at least one density sensor, out of the density signals Va, Vb, and Vc shown in FIG. 3A.

Next, in step S413, the correction signal generating unit 30*c* generates a correction signal which is a sinusoidal signal with a phase which is reverse that of a periodic pattern corresponding to the density fluctuations in the sub-scanning direction. Next, in step S415, the correction signal generating unit 30*c* causes a correction signal pattern generated in step S413 to, for example, undergo an A/D conversion to save the converted pattern in the memory, etc. Only a periodic pattern of a correction signal that corresponds to one period may be saved as a basic pattern.

Next, in step S417, the correction signal generating unit 30*c* obtains an average value (see FIG. 3B, for example) for each density sensor for the respective density signals (density signals Va, Vb, and Vc shown in FIG. 3A, for example) of the density sensors 18*a*, 18*b*, and 18*c* that correspond to the density fluctuation detecting pattern 20.

Next, in step S419, the correction signal generating unit 30*c* generates an approximation formula (a formula which shows a pattern of an interpolation signal Sx shown in FIG. 3C, for example) corresponding to the density fluctuations in the main scanning direction. Next, in step S421, the correction signal generating unit 30*c* generates a light emitting power correction formula (for example, a formula which shows a pattern of the correction signal Hb in FIG. 3C) for correcting the density fluctuations in the main scanning direction. Next, in step S423, the correction signal generating unit 30*c* saves, in the memory, etc., a light emitting power correction formula generated in step S421.

Thereafter, based on the light emitting power correction formula saved in step S423 and the correction signal pattern saved in step S415, the correction signal generating unit 30*c* generates a light amount control signal A in which both are convolved, and performs light emitting level control of the light source 13 with a light amount based on the light amount control signal A. In this way, the respective density fluctuations in the main scanning direction and the sub-scanning direction may be reduced by control of a light amount of the light source 13. In other words, a density fluctuation correction is performed with a method in FIG. 6 to obtain a high quality image on the intermediate transfer belt 17, in which image, density fluctuations in the main scanning direction and the sub-scanning direction are reduced.

In this way, setting an image area rate of the density fluctuation detecting pattern between 50% and 85% causes a wide dynamic range of density correction, so that accurate density fluctuation data for density fluctuation correction can be obtained for density fluctuations caused by the drum, making it possible to realize the correction with a simple configuration.

Second Embodiment

Figure 8:
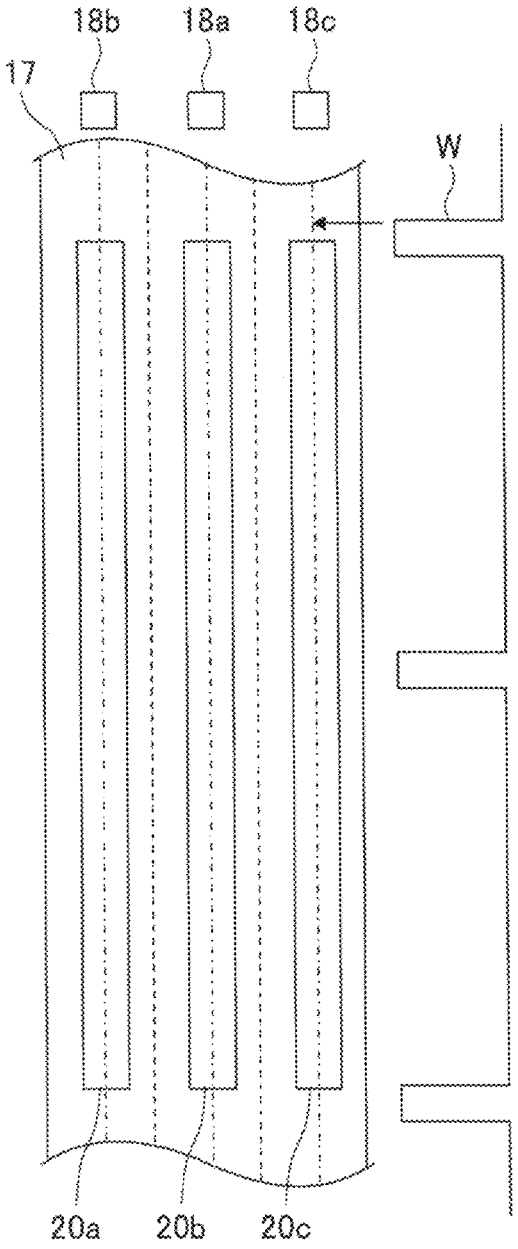
FIG. 8 is a diagram exemplifying a density fluctuation detecting pattern according to a second embodiment.

In a second embodiment, an example of a density fluctuation detecting pattern which is different from the first embodiment is shown. FIG. 8 is a diagram exemplifying a density fluctuation detecting pattern according to the second embodiment. With reference to FIG. 8, the density fluctuation detecting patterns 20*a*, 20*b*, and 20*c* with a sub-scanning direction for detecting density fluctuations as a longitudinal direction are arranged immediately below the density sensors 18*a*, 18*b*, and 18*c* which are arranged in multiple numbers in the main scanning direction.

The density fluctuation detecting patterns 20*a*, 20*b*, and 20*c* can be formed to suppress an amount of consumption of toner with an advantageous effect equivalent to that of the density fluctuation detecting pattern 20 shown in FIG. 2A.

Third Embodiment

Figure 9:
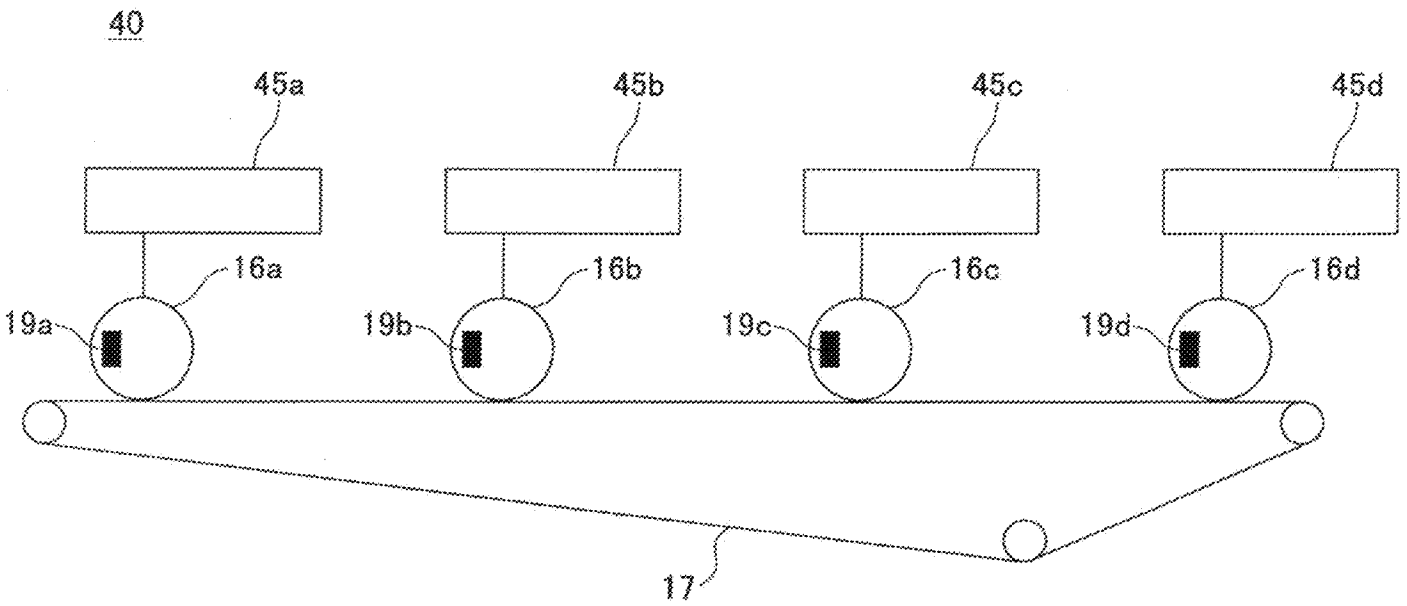
FIG. 9 is a diagram exemplifying the image forming apparatus having multiple drums.

According to a third embodiment is shown an example in which the present invention is applied to a tandem color machine which includes multiple photosensitive bodies. FIG. 9 is a diagram exemplifying an image forming apparatus including multiple drums (photosensitive bodies). With reference to FIG. 9, the image forming apparatus 40, which includes a configuration in which optical scanning apparatuses 45*a*, 45*b*, 45*c*, and 45*d* corresponding to the colors of cyan, magenta, yellow, and black, for example, along the intermediate transfer belt 17, which is an endless belt, is a so-called tandem-type image forming apparatus. The intermediate transfer belt 17 is an endless belt which is wound around various rollers which are rotationally driven.

The optical scanning apparatuses 45*a*, 45*b*, 45*c*, and 45*d*, which respectively include light sources (not shown), direct light beams emitted from the light sources to the respective drums 16*a*, 16*b*, 16*c*, and 16*d* via a deflector (not shown) and multiple optical components (not shown) and form a latent image on the respective drums 16*a*, 16*b*, 16*c*, and 16*d*.

In the vicinity of the drums 16*a*, 16*b*, 16*c*, and 16*d* are arranged HP sensors 19*a*, 19*b*, 19*c*, and 19*d*, respectively. Functions of the HP sensors 19*a*, 19*b*, 19*c*, and 19*d* are the same as those of the HP sensor 19 which were described in the first embodiment.

In the image forming apparatus 40, the rotational timing or period may differ somewhat for each of the drums 16*a*, 16*b*, 16*c*, and 16*d*. In other words, for the image forming apparatus 40, a drum differs for each of colors of cyan, magenta, yellow, and black, so that timings for generating an HP signal for each drum also differs. Thus, when density fluctuation detecting pattern of each color is generated onto the intermediate transfer belt 17, a density detecting pattern is generated in response to a timing of an HP signal which differs from color to color. In this way, from an aspect of image quality, an image with good color reproducibility in which density fluctuations for each of the drums 16*a*, 16*b*, 16*c*, and 16*d* are effectively reduced is obtained.

Figure 10:
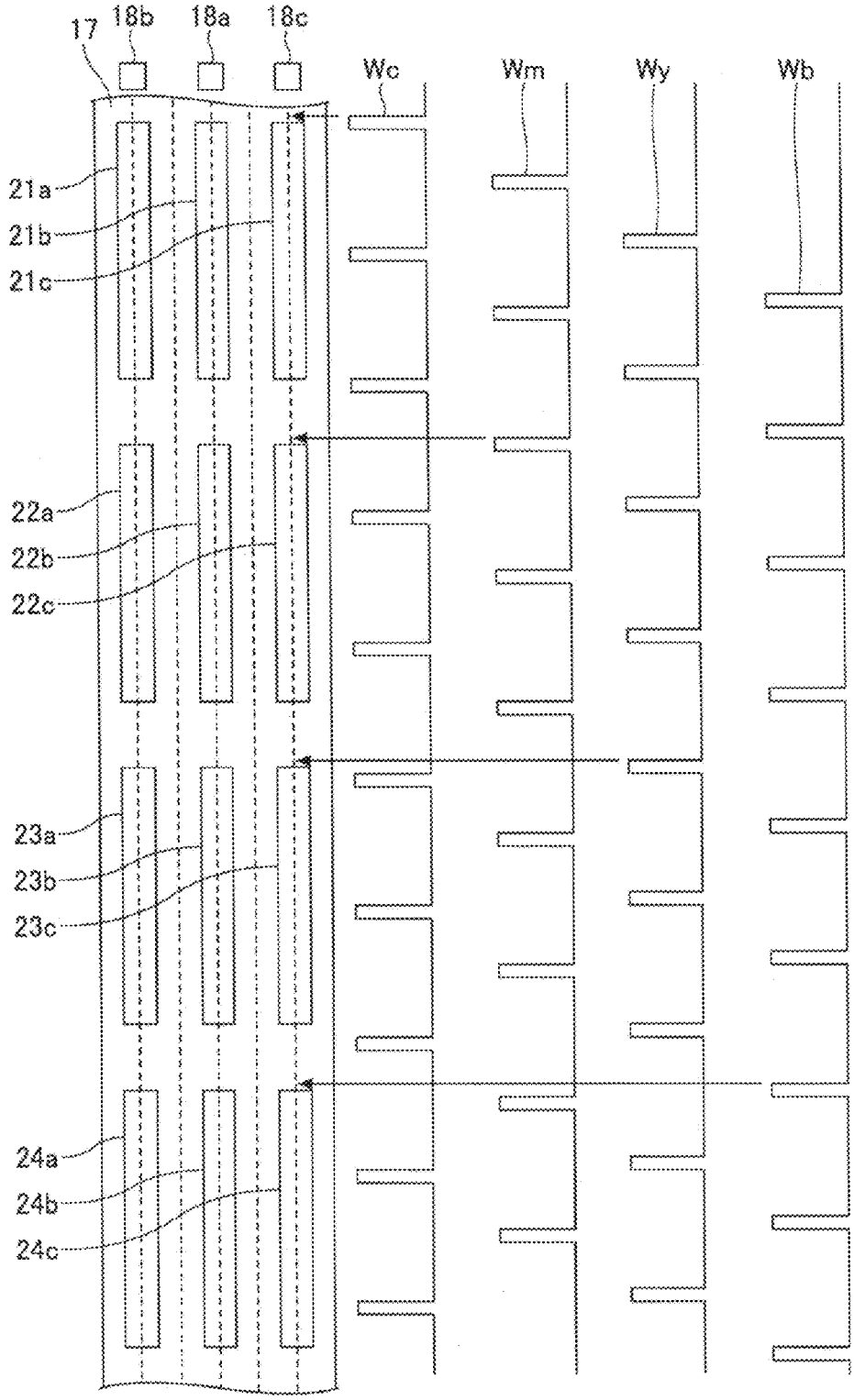
FIG. 10 is a diagram exemplifying the density fluctuation detecting pattern according to a third embodiment.

FIG. 10 is a diagram exemplifying a density fluctuation detecting pattern according to a third embodiment. In FIG. 10, density fluctuation detecting patterns 21*a*, 21*b*, and 21*c* which are formed in parallel in the main scanning direction are cyan patterns; density fluctuation detecting patterns 22*a*, 22*b*, and 22*c* which are formed in parallel in the main scanning direction are magenta patterns; density fluctuation detecting patterns 23*a*, 23*b*, and 23*c* which are formed in parallel in the main scanning direction are yellow patterns; and density fluctuation detecting patterns 24*a*, 24*b*, and 24*c* which are formed in parallel in the main scanning direction are black patterns.

Moreover, in FIG. 10, an HP signal Wc is an output signal from the HP sensor 19*a* corresponding to cyan; an HP signal Wm is an output signal from the HP sensor 19*b* corresponding to magenta; an HP signal Wy is an output signal from the HP sensor 19*c* corresponding to yellow; and an HP signal Wb is an output signal from the HP sensor 19*d* corresponding to black.

In FIG. 10, the cyan density fluctuation detecting patterns 21*a*, 21*b*, and 21*c* corresponding to two periods of the HP signal Wc are generated; then, at a different position in the sub-scanning direction, the magenta density fluctuation detecting patterns 22*a*, 22*b*, and 22*c* corresponding to two periods of the HP signal Wm are generated; then, at a different position in the sub-scanning direction, the yellow density fluctuation detecting patterns 23*a*, 23*b*, and 23*c* corresponding to two periods of the HP signal Wy are generated; and then, at a different position in the sub-scanning direction, the black density fluctuation detecting patterns 24*a*, 24*b*, and 24*c* corresponding to two periods of the HP signal Wb are generated.

The reason that the density fluctuation detecting pattern corresponding to two periods of the respective HP signals is generated is that there may a case in which an S/N ratio is small at a time of detecting by a density sensor with only a density fluctuation detecting pattern corresponding to one period of the respective HP signals. Therefore, in order to increase an S/N ratio when detecting by the density sensor, a density fluctuation detecting pattern corresponding to at least three periods of the respective HP signals may be formed.

A density fluctuation detecting pattern formed that corresponds to multiple periods of the respective HP signals may be detected by each density sensor and an average processing may be performed among signals at the same position to more accurately detect periodic density fluctuations which are caused by a drum shape, etc. Therefore, a correction signal may be generated based on the density signal and a light amount of a light source may be controlled to realize an apparatus which forms an image with a high image quality in which density fluctuations are reduced.

Fourth Embodiment

Figure 11:
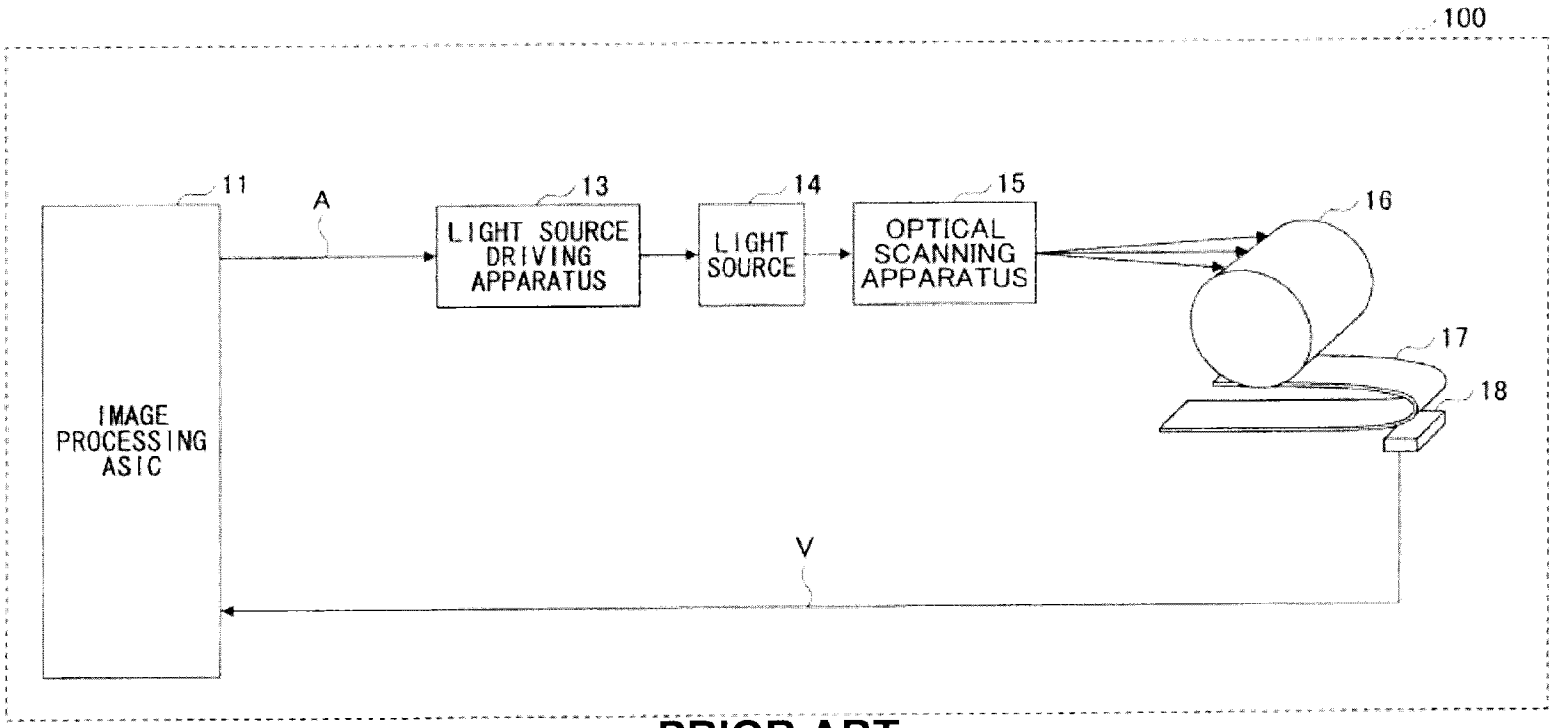
FIG. 11 is a schematic diagram exemplifying the image forming apparatus according to a comparative example.

First, in describing an image forming apparatus according to a fourth embodiment, a related-art image forming apparatus as a comparative example is described. FIG. 11 is a schematic diagram exemplifying the image forming apparatus according to the comparative example. With reference to FIG. 11, an image forming apparatus 100 according to a comparative example includes an image processing ASIC 11; a light source driving apparatus 13; a light source 14; an optical scanning apparatus 15; a drum 16; an intermediate transfer belt 17; and a density sensor 18.

In FIG. 11, a light amount control signal A (main shading data) which is output from the image processing ASIC 11 is a light amount control signal in a main scanning direction (rotational axle direction) of the drum 16. The optical control signal A is input to the light source driving apparatus 13, which drives the light source 14 with a light amount based on the light amount control signal A and performs light emitting level control of the light source 14 (controls exposure power of the light source 14). As the light source 14, a semiconductor laser, etc., may be used, for example. As a semiconductor laser, a VCSEL (Vertical Cavity Surface Emitting LASER), etc., may be used, for example.

A light beam emitted from the light source 14 is transmitted toward the drum 16, which is a photosensitive body, by the optical scanning apparatus 15, and a latent image is formed on a surface of the drum 16. The optical scanning apparatus 15 includes, for example, a deflecting and scanning unit (not shown) which deflects and scans, in the main scanning direction, the light beam emitted from the light source 14; a scanning and image forming unit (not shown) which collects the deflected and scanned light beam onto the drum 16, which is a face to be scanned, etc.

Then, after undergoing processes of developing and transferring, a toner whose amount is based on a light emitting amount and a light emitting time of the light source 14 is affixed onto the intermediate transfer belt 17 and a predetermined image is formed. The intermediate transfer belt 17 is an endless belt which is arranged to be in contact with the drum 16 and onto which an image corresponding to the latent image is formed.

The density sensor 18 reads a density of a toner pattern formed onto the intermediate transfer belt 17, and outputs, to the image processing ASIC 11, a density signal V, which is an output signal in which an affixed amount of toner is converted to a voltage. For example, the density sensor 18 may be arranged such that a light emitted by an LED is irradiated onto the intermediate transfer belt 17 and a specularly reflected light and a diffuse reflected light which are obtained in accordance with a toner density on the intermediate transfer belt 17 is detected by a light receiving element.

Figure 12:
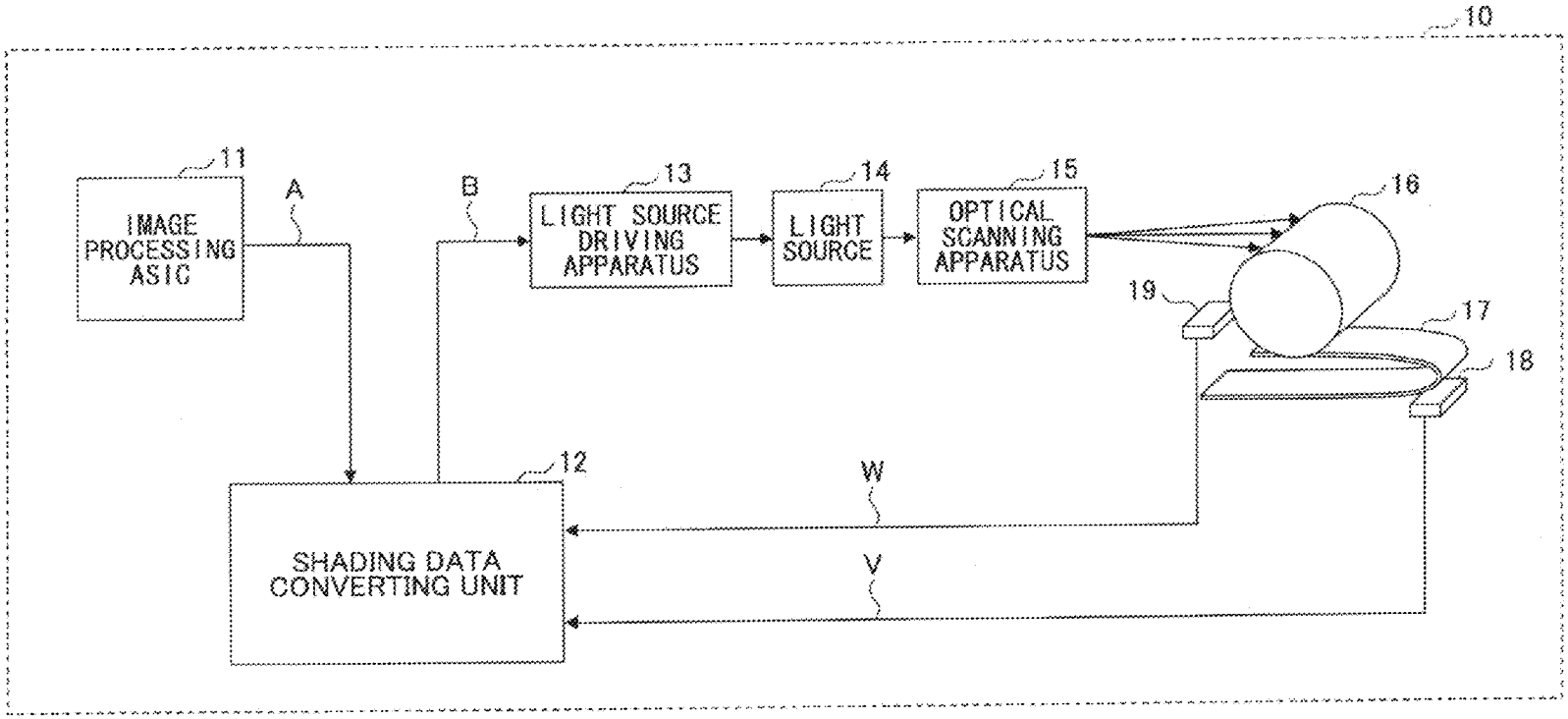
FIG. 12 is a schematic diagram exemplifying the image forming apparatus according to a fourth embodiment.

FIG. 12 is a schematic diagram exemplifying an image forming apparatus according to the fourth embodiment. With reference to FIG. 12, the image forming apparatus 10 is different from the image forming apparatus 100 (see FIG. 11) in that a shading data converting unit 12 and a home position sensor 19 (which may be called a HP sensor 19 below) are added. The image forming apparatus 10 not only corrects for shading in the main scanning direction as in the image forming apparatus 100, but also corrects shading in the sub-scanning direction.

In the image forming apparatus 10, a light amount control signal A (main shading data) output from the image processing ASIC 11, a density signal V which is output from the density sensor 18, and a home position signal W (which may be called an HP signal W below) which is output from the HP sensor 19 are respectively input to the shading data converting unit 12. The HP sensor 19 is a period detecting sensor which detects a rotational period of the drum 16.

The shading data converting unit 12 includes a function of generating sub-shading data which corrects for shading in the sub-scanning direction as a signal which is synchronized to the HP signal W, etc. Moreover, it includes a function of multiplying the generated sub-shading data with the light amount control signal A (main shading data) to generate a light amount control signal B (main shading data+ sub-shading data).

The shading data converting unit 12 includes a CPU, a ROM, a main memory, etc., for example, various functions of which shading data converting unit 12 are realized by a program recorded in the ROM, etc., being read into the main memory to be executed by the CPU. A part or the whole of the shading data converting unit 12 may be realized by hardware only. Moreover, the shading data converting unit 12 may physically be configured with multiple apparatuses.

The light amount control signal B is input to the light source driving apparatus 13, which controls a light emitting level of the light source 14 with a light amount based on the light amount control signal B. In this way, the respective density fluctuations in the main scanning direction and the sub-scanning direction may be decreased by control of a light amount of the light source 14. It is also possible to control the light source 14 based on only sub-shading data, not combining the generated sub-shading data with the light amount control signal A (the main shading data), and correct for shading only in the sub-scanning direction. The main scanning direction is a direction which is orthogonal to a conveying direction of the intermediate transfer belt 17, while the sub-scanning direction is the conveying direction of the intermediate transfer belt 17.

Figure 13:
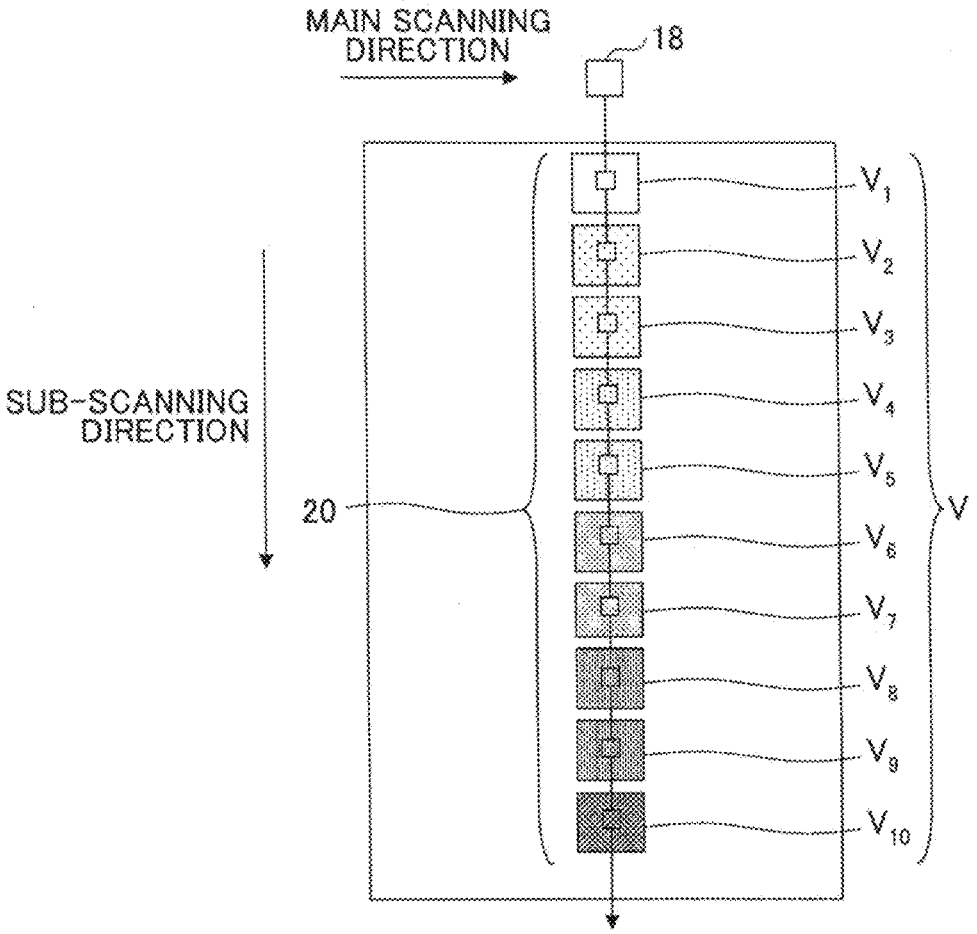
FIG. 13 is a first part of a diagram for describing density calibration.
Figure 14:
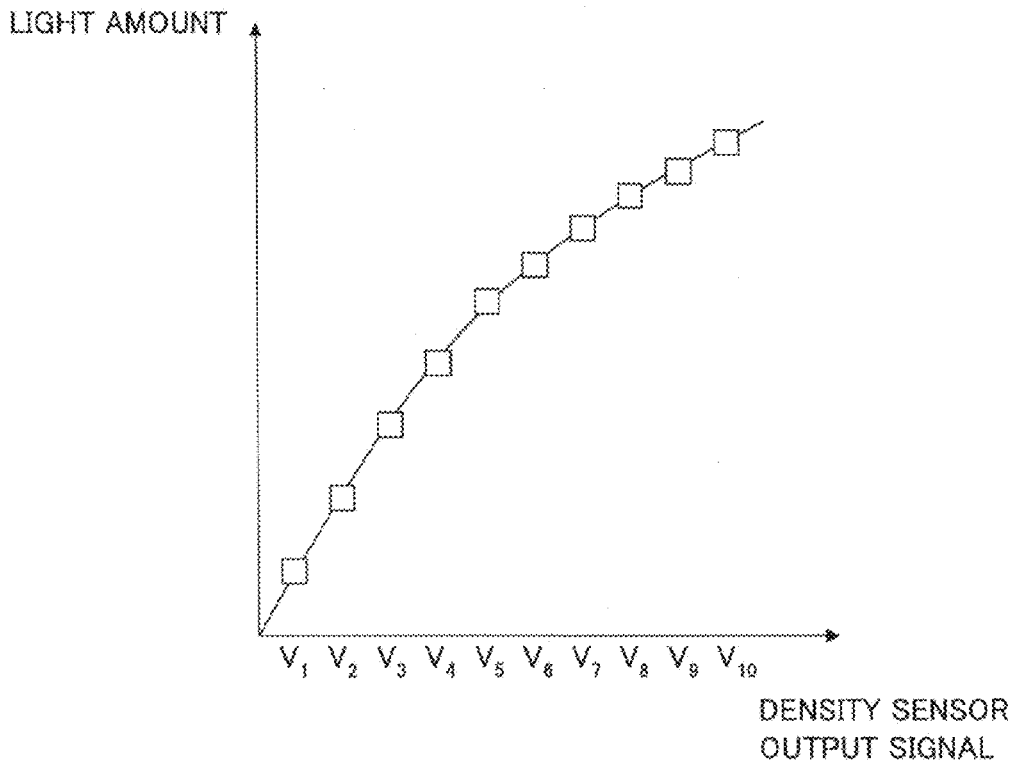
FIG. 14 is a second part of the diagram for describing density calibration.

FIGS. 13 and 14 are diagrams for describing density calibration. As shown in FIG. 13, a case is considered of successively increasing an amount of light for forming a pattern; drawing, in the sub-scanning direction, a density calibrating pattern 20 which includes ten rectangular-shaped patterns with differing densities; and detecting, by the density sensor 18 on the sub-scanning line, a density signal V (including $V_1$ to $V_{10}$) which corresponds to the respective patterns which makes up the density calibrating pattern 20.

Then, between the respective patterns which make up the density calibrating pattern 20 and the light amount increased for changing the density, there is a generally linear relationship. Moreover, there is also a generally linear relationship between the density in the respective patterns which make up the density calibrating pattern 20 and the density signal V (including $V_1$ to $V_{10}$), and generally linear relational data between the light amount and the density signal V (including $V_1$ to $V_{10}$) may be obtained as shown in FIG. 14. Moreover, an actual print may be performed to measure an image density with a colorimeter, a scanner, etc., and a correspondence thereof with the density signal V (including $V_1$ to $V_{10}$) may be made to take a correlation between an actual image density and the density signal V (including $V_1$ to $V_{10}$).

Figure 15:
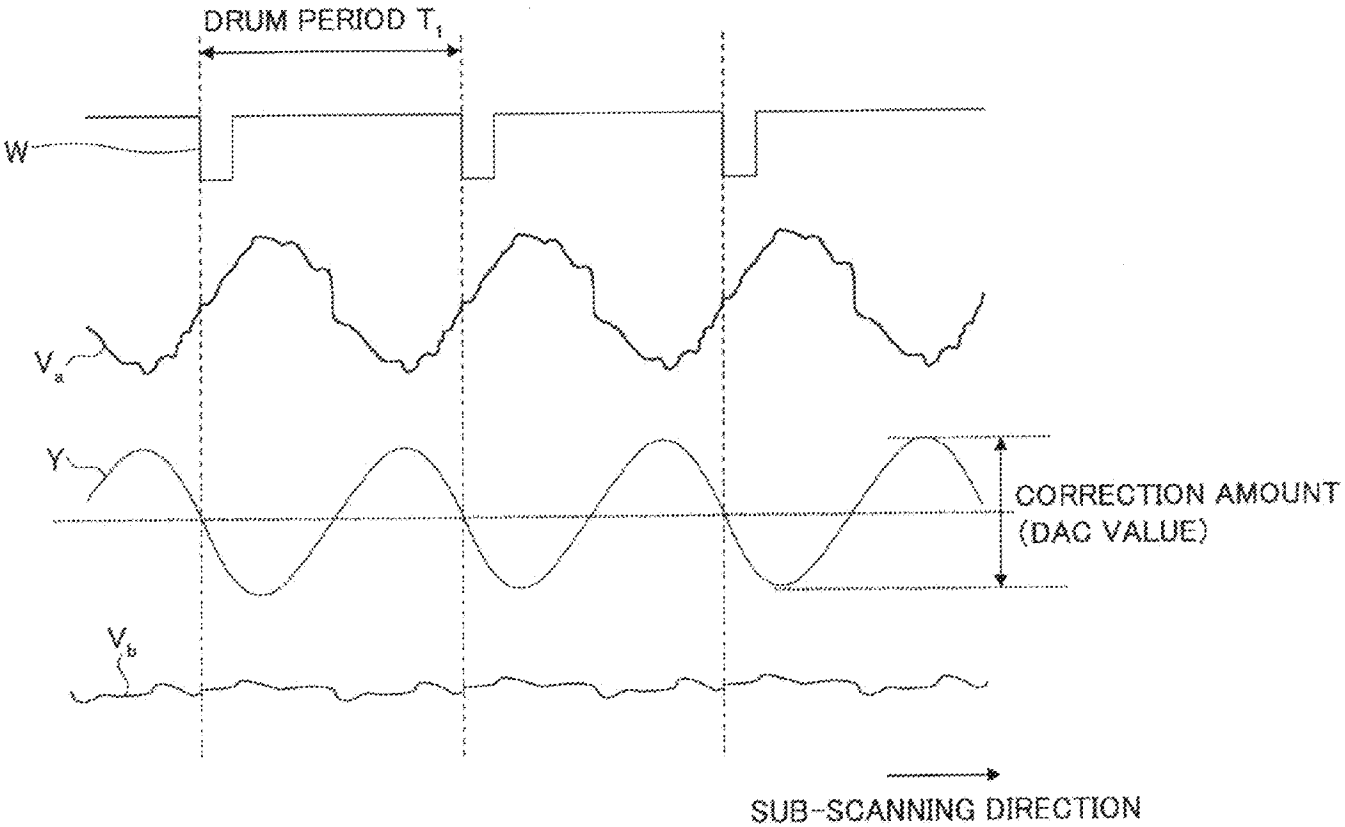
FIG. 15 is a diagram for describing a method of density correction.

FIG. 15 is a diagram for describing a density correction method. For example, a case is considered of forming a certain density pattern in multiple numbers within a time width of a period $T_1$ of the drum 16.

Here, a period $T_1$ in a drum 16 is not necessarily equivalent to a print size, and a print starting position relative to the drum 16 is not constant. As density fluctuations of the drum 16 with a period $T_1$ occur, with an HP signal W as a trigger, an HP sensor 19 may be provided to specify the period $T_1$ of the drum 16.

A phase and the period $T_1$ of the drum 16 are specified by the HP sensor 19 to obtain a density signal Va, which is close to a sinusoidal wave with the same period as the period $T_1$ of the drum 16 from the density sensor 18. Based on density fluctuations of the density signal Va, as a correction signal Y, a sinusoidal signal with a phase which is reverse that of a density fluctuation Va and the same period as a period $T_1$ of the drum 16 may be generated. Amplitude of the sinusoidal signal becomes a correction amount.

Forming the density fluctuation detecting pattern by inputting, into the light source driving apparatus 13, a correction signal Y with a phase which is reverse that of the density fluctuation Va to control a light amount of the light source 14 makes it possible to reduce density fluctuations of the formed density fluctuation detecting pattern in the sub-scanning direction. In other words, when the density fluctuation detecting pattern which is formed using the correction signal Y is detected by the density sensor 18, a signal whose amplitude is smaller than that of the density signal Va, such as a density signal Vb, is obtained. In the density signal Vb, a density fluctuating component with the period $T_1$ of the drum 16 is reduced relative to the density signal Va.

Figure 16A:
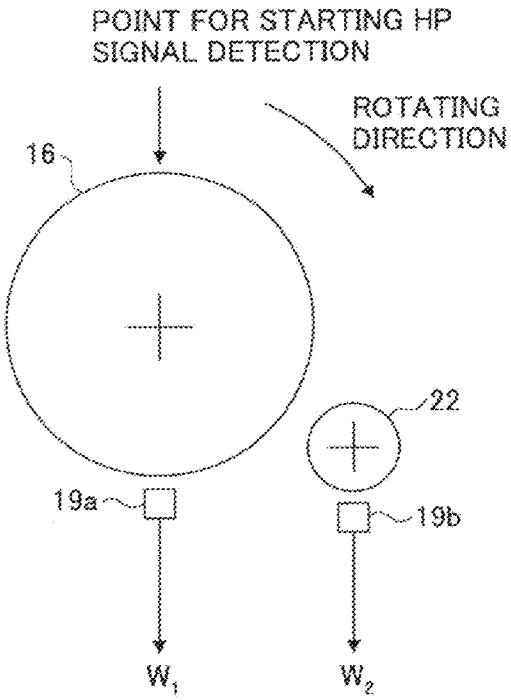
FIG. 16A is a diagram for describing an example of density fluctuations in the sub-scanning direction according to drum circularity.
Figure 16B:
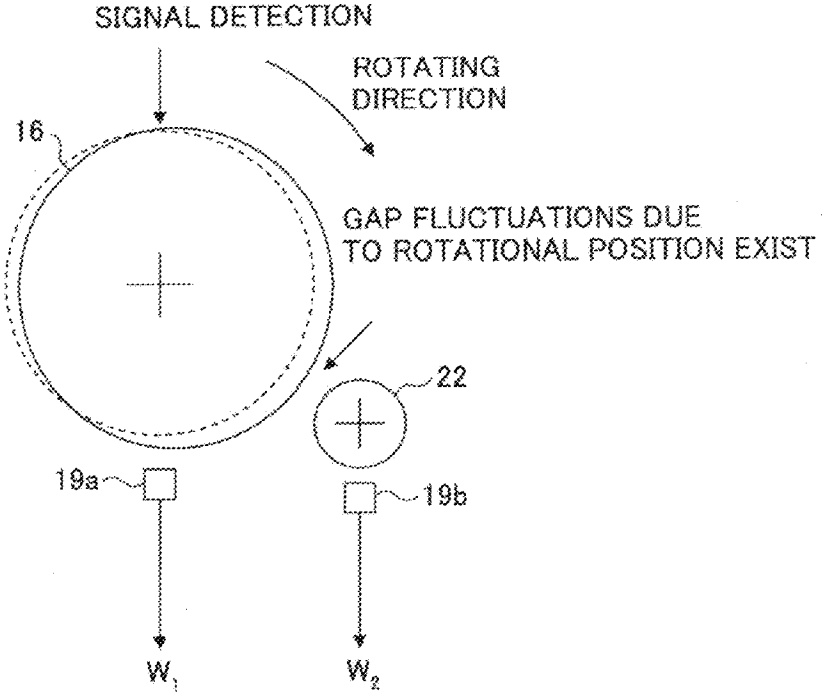
FIG. 16B is another diagram for describing an example of density fluctuations in the sub-scanning direction according to the drum circularity.
Figure 17:
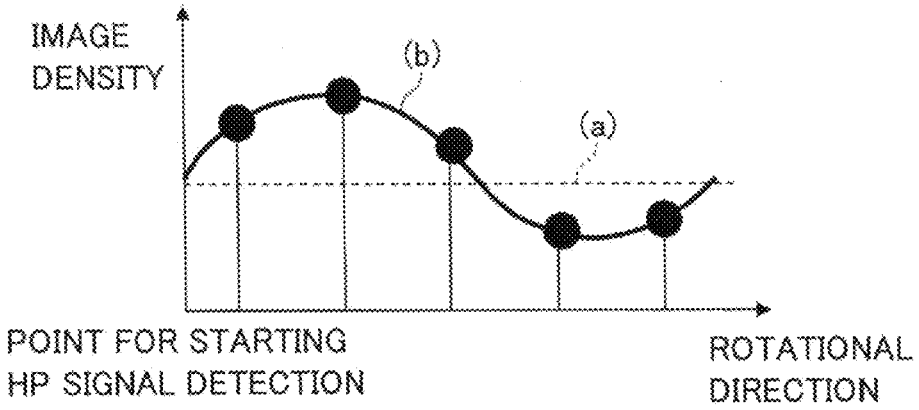
FIG. 17 is a further diagram for describing an example of density fluctuations in the sub-scanning direction according to the drum circularity.

While not shown in FIG. 12, in practice, as shown in FIGS. 16A, 16B, and FIG. 17, a developing roller 22, which is a rotating body, is located at a position opposing the drum 16, between which an intermediate transfer belt 17 (not shown) is placed. In other words, with the intermediate transfer belt 17 being placed between the drum 16 and the developing roller 22, rotating of the drum 16 and the developing roller 22 in a predetermined direction causes the intermediate transfer belt 17 to be conveyed in the sub-scanning direction. The developing roller 22 includes a function of developing a latent image which is formed onto the drum 16.

Then, the HP sensor 19 includes an HP sensor 19*a* which detects a home position of the drum 16 and an HP sensor 19*b* which detects a home position of the developing roller 22. The HP sensor 19*a* is a first period detecting sensor which detects density fluctuations of a period $T_1$ which corresponds to rotating of the drum 16, while the HP sensor 19*b* is a second period detecting sensor which detects density fluctuations of a period $T_2$ which corresponds to rotating of the developing roller 22 which is different from a rotational period of the drum 16. The HP sensor 19*a* outputs an HP signal $W_1$ to the shading data converting unit 12, while the HP sensor 19*b* outputs an HP signal $W_2$ to the shading data converting unit 12. The period $T_1$ is one representative example of the first period according to the present invention, while the period $T_2$ is one representative example of the second period according to the present invention.

With reference to FIGS. 16A, 16B, and 17, an example is described of density fluctuations in the sub-scanning direction due to the circularity of the drum 16. An image density varies depending on a gap between the drum 16 and the developing roller 22. As shown in FIG. 16A, when the drum 16 is circular, the image density stabilizes to a certain value as shown in a broken line (a) in FIG. 17. On the other hand, as shown in FIG. 16B, when the circularity of the drum 16 is low, a gap fluctuation occurs due to a rotational position as shown in solid and broken lines of the drum 16, so that the image density also changes with rotating of the drum 16.

In FIG. 16B, there are two fluctuating portions with a diameter which is larger and with a diameter which is smaller relative to a circle, so that as shown with a solid line (b) in FIG. 17, a density of an image corresponding to one period ($T_1$) of the drum 16 appears as a density fluctuation which is close to a sinusoidal wave having two inflection points. Therefore, it is desirable to generate around at least five locations of density fluctuation detecting patterns as shown in black circles in FIG. 17 between output signals of the HP sensor 19*a* that corresponds to one period of the drum 16 to detect density fluctuations.

Figure 18:
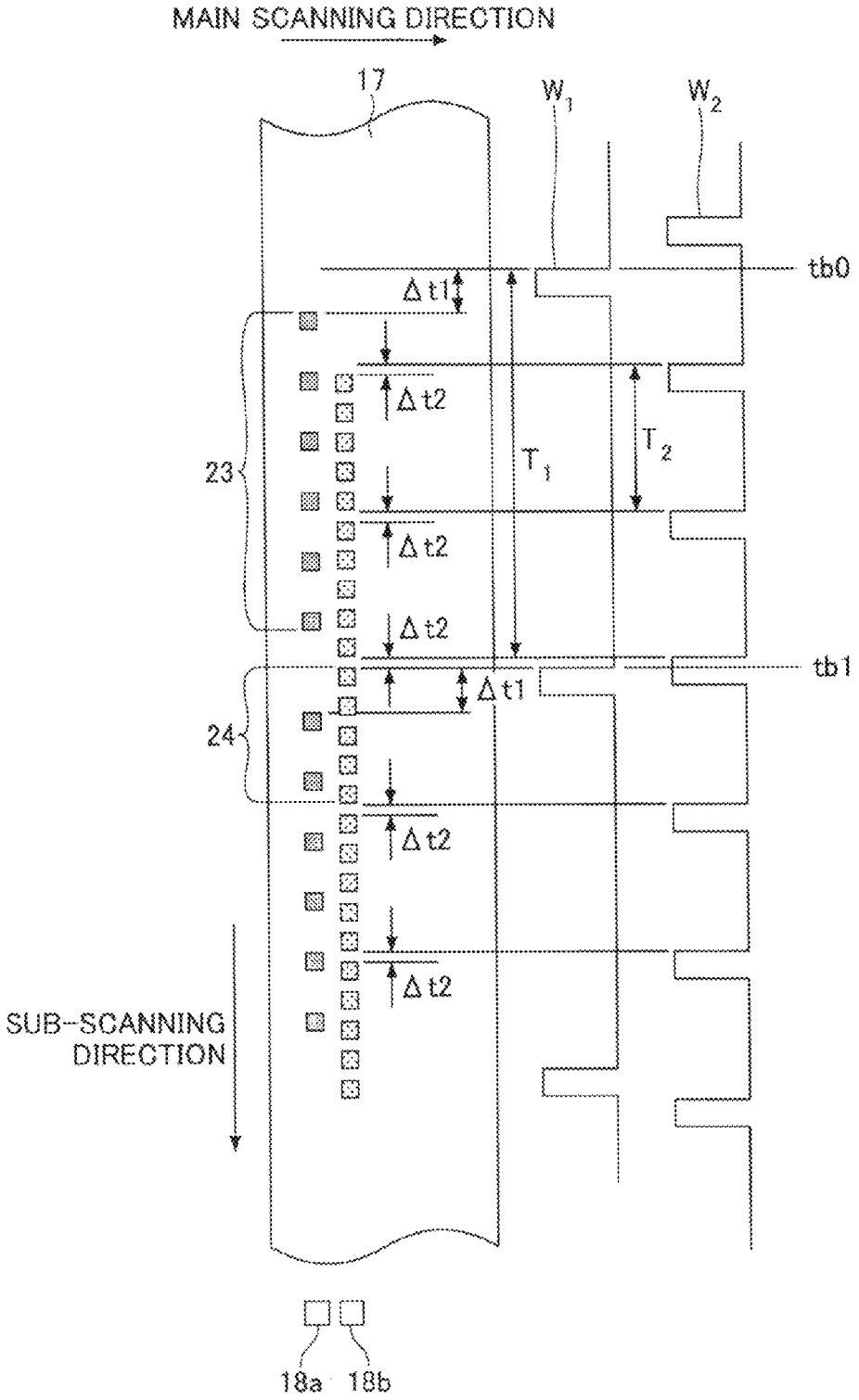
FIG. 18 is a diagram exemplifying a density fluctuation detecting pattern according to the fourth embodiment.

FIG. 18 is a diagram exemplifying a density fluctuation detecting pattern according to the fourth embodiment. With reference to FIG. 18, for density fluctuation detection, on the intermediate transfer belt 17 are formed density fluctuation detecting patterns 23 and 24 at different positions in the vertical direction (the main scanning direction) relative to the conveying direction of the intermediate transfer belt 17 (rotating direction of the drum 16). The respective density fluctuation detecting patterns 23 and 24, which are shown in FIG. 18, are representative examples of the first density fluctuation detecting pattern and the second density fluctuation detecting pattern according to the present invention.

The density fluctuation detecting pattern 23, which is a pattern formed in synchronicity with the HP signal $W_1$ which is detected with rotating of the drum 16, has a first occurrence period. While the first occurrence period is set to six patterns within a period $T_1$ of the HP signal $W_1$ in an example in FIG. 18, it is not limited thereto.

Moreover, the density fluctuation detecting pattern 24, which is a pattern formed in synchronicity with the HP signal $W_2$ which is detected with rotating of the developing roller 22, has a second occurrence period which is different from the first occurrence period. While the second occurrence period is set to five patterns within a period $T_2$ of the HP signal $W_2$ in an example in FIG. 18, it is not limited thereto. A pattern interval of the density fluctuation detecting pattern 24 may be set to be a constant interval for a multiple number of periods of the period $T_2$.

The density fluctuation detecting pattern 23 is generated from a time which is delayed by Δt1, for example, relative to a rise of the HP signal $W_1$ of period $T_1$ (from tb0 to tb1) while the density fluctuation detecting pattern 24 can be generated from a time which is delayed by Δt2, for example, relative to a rise of the HP signal $W_2$ of period $T_2$.

Figure 19:
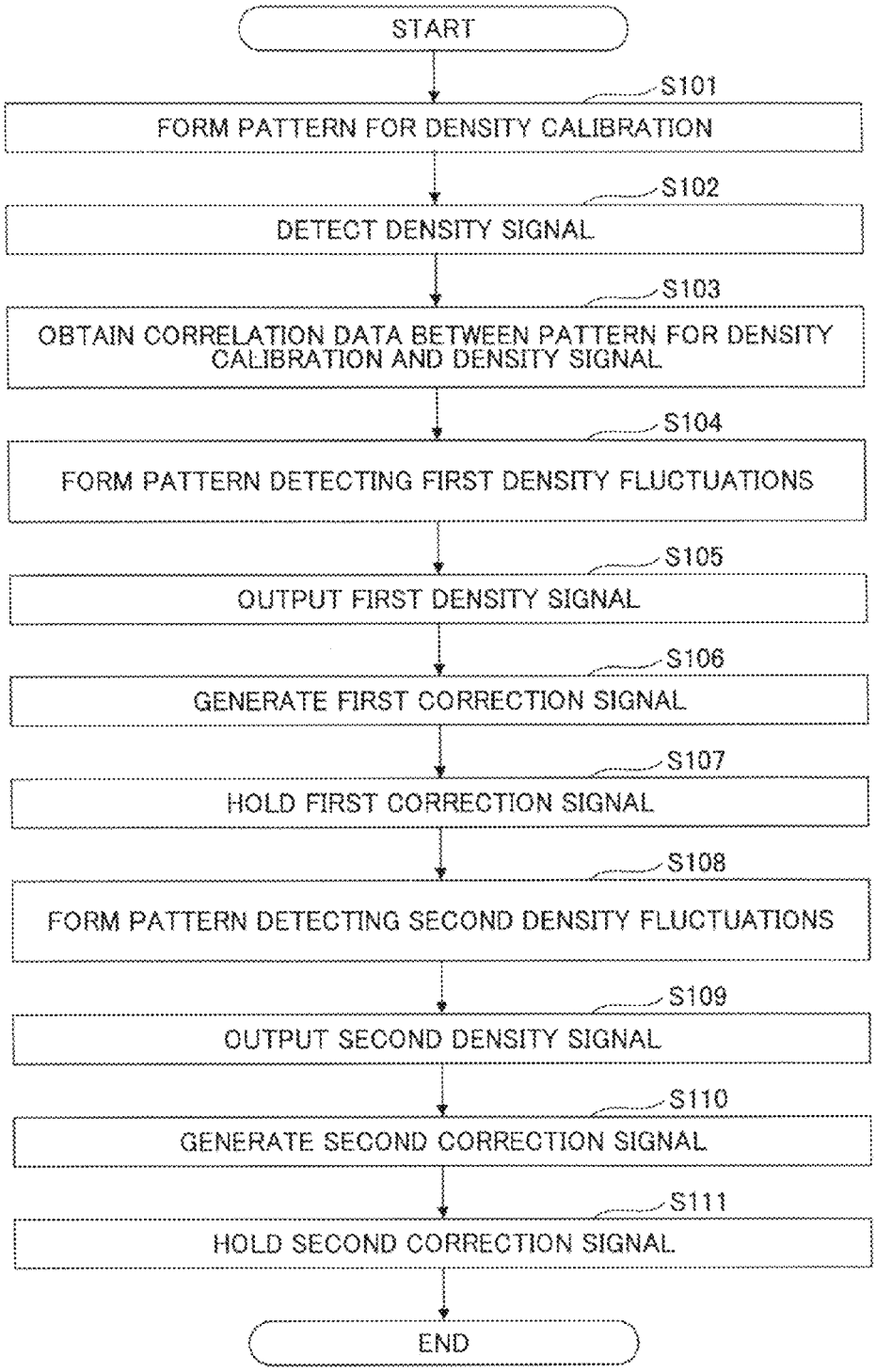
FIG. 19 is a diagram illustrating one example of a flowchart on density fluctuation correction according to the fourth embodiment.
Figure 20:
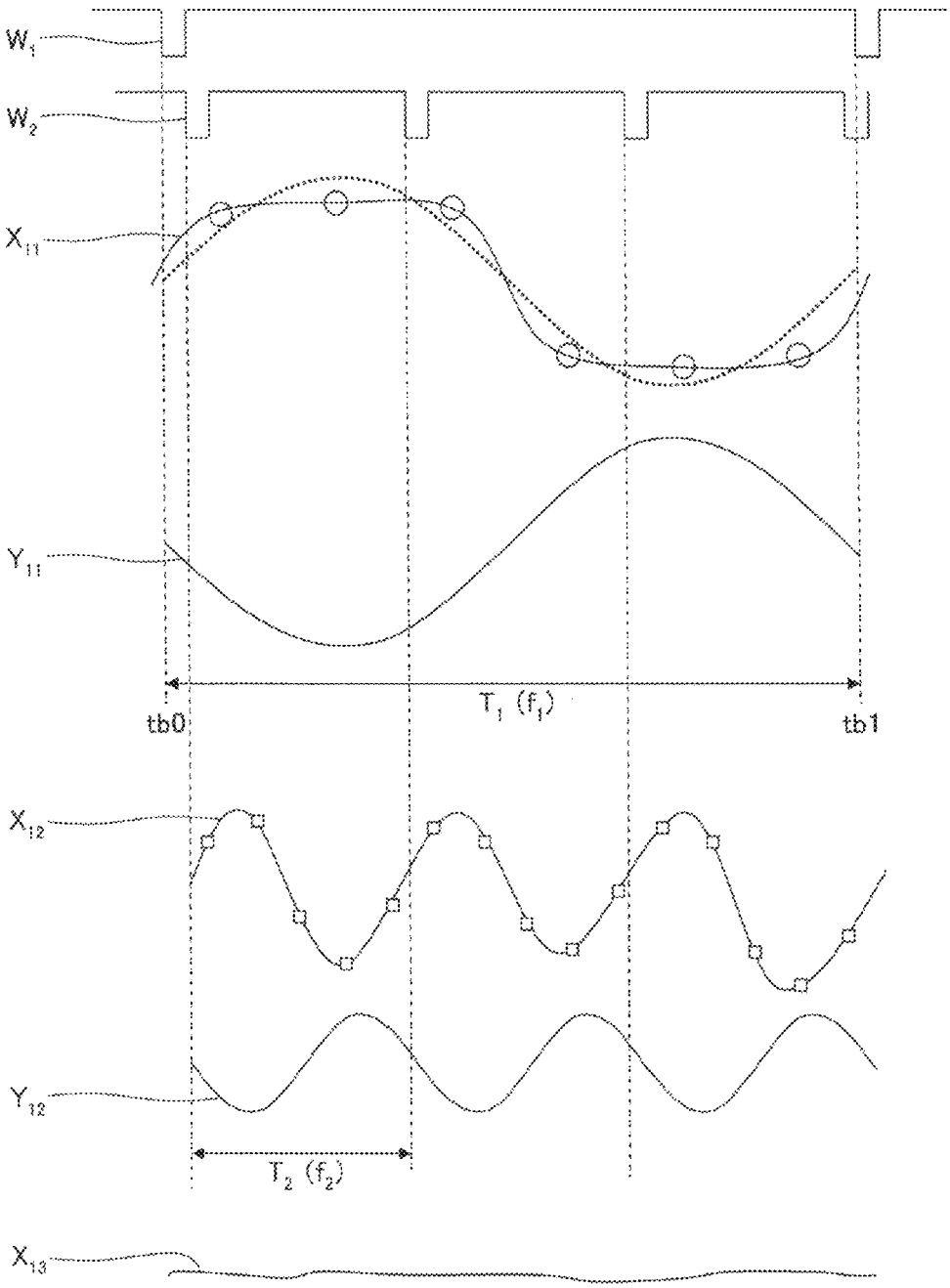
FIG. 20 is a diagram exemplifying various signals related to density fluctuation correction according to the fourth embodiment.
Figure 21:
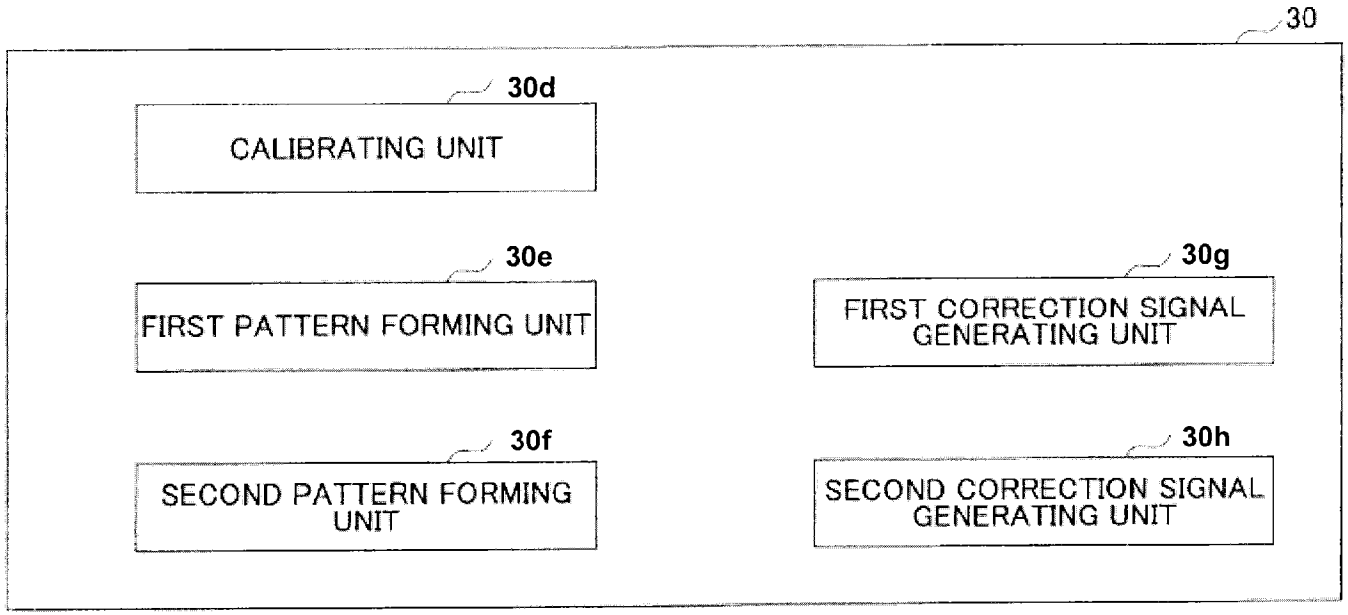
FIG. 21 is a functional block diagram of a density fluctuation correcting unit according to the fourth embodiment.

Now, with reference to FIGS. 19 to 21, a density fluctuation correction using the density fluctuation detecting patterns 23 and 24 which are shown in FIG. 18 is described. FIG. 19 is an example of a flowchart on density fluctuation correction according to the fourth embodiment. FIG. 20 is a diagram exemplifying various signals related to density fluctuation correction according to the fourth embodiment. FIG. 21 is a functional block diagram of a density fluctuation correcting unit 30 according to the fourth embodiment.

A calibrating unit 30*d*, a first pattern forming unit 30*e*, a second pattern forming unit 30*f*, a first correction signal generating unit 30*g*, and a second correction signal generating unit 30*h* which are shown in FIG. 21 may be realized by the shading data converting unit 12, the light source driving unit 13, the light source 14, the optical scanning apparatus 15, etc.

With reference to FIGS. 19 to 21, first, in step S101, the calibrating unit 30*d* forms two columns of density calibrating patterns 20 having 10 rectangular patterns with differing densities as shown in FIG. 13, for example, at a position (in the sub-scanning direction) corresponding to density sensors 18*a* and 18*b* on the intermediate transfer belt 17. Next, in step S102, the density sensors 18*a* and 18*b* respectively detect density signals from the density calibrating patterns 20 of the two columns.

Next, in step S103, the calibrating unit 30*d* obtains correlation data between the density signal and density calibrating pattern 20 of each column as shown in FIG. 14, for example. In this way, a correlation is taken between the density signals obtained from the density sensors 18*a* and 18*b* and the density calibrating pattern 20 of each column. In other words, a correspondence between amplitude of a density signal and a density of an image formed onto the intermediate transfer belt 17 is identified, making it possible to discriminate a magnitude of the density relative to the density signal.

Next, in step S104, the first pattern forming unit 30*e* forms the density fluctuation detecting pattern 23 (a first density fluctuation detecting pattern) as shown in FIG. 18, for example, in a position corresponding to the density sensor 18*a* on the intermediate transfer belt 17 along a conveying direction of the intermediate transfer belt 17. Next, in step S105, the density sensor 18*a* detects a density fluctuation detecting pattern 23 and outputs a first density signal $X_{11}$ as shown in FIG. 20, for example. The first density signal $X_{11}$ is a signal which includes information on density fluctuations in a conveying direction of the intermediate transfer belt 17.

Next, in step S106, the first correction signal generating unit 30*g* generates a first correction signal $Y_{11}$ (a signal with a period $T_1$ and a frequency $f_1$), which is a sinusoidal signal with a phase which is reverse that of density fluctuations as shown in FIG. 20, for example, based on a first density signal $X_{11}$. Next, in step S107, the first correction signal generating unit 30*g* causes a value of the first correction signal $Y_{11}$ generated in step S106 to undergo A/D conversion, for example, to hold the converted result in a memory (not shown), etc.

Next, in step S108, the second pattern forming unit 30*f* inputs the first correction signal $Y_{11}$ in the light source driving apparatus 13 to control a light amount of the light source 14 to form a density fluctuation detecting pattern 24 (a second density fluctuation detecting pattern). Next, in step S109, the density sensor 18*b* detects the density fluctuation detecting pattern 24 and outputs a second density signal $X_{12}$ as shown in FIG. 20, for example. The second density signal $X_{12}$ is a signal which includes information on density fluctuations in the conveying direction of the intermediate transfer belt 17.

Next, in step S110, the second correction signal generating unit 30*h* generates a second correction signal $Y_{12}$ (a signal with a period $T_2$ and a frequency $f_2$), which is a sinusoidal signal with a phase which is reverse that of density fluctuations as shown in FIG. 20, for example, based on a second density signal $X_{12}$. Next, in step S111, the second correction signal generating unit 30*h* causes a value of the second correction signal $Y_{12}$ generated in step S110 to undergo A/D conversion, for example, to hold the converted result in a memory (not shown), etc.

Thereafter, the second correction signal $Y_{12}$, which is held in the memory (not shown), etc., may be input into the light source driving apparatus 13 to control a light amount signal of the light source 14 to form a density fluctuation detecting pattern in which density fluctuations with periods $T_1$ and $T_2$ are reduced. When the density fluctuation detecting pattern, which is corrected with the second correction signal $Y_{12}$, is detected with a density sensor, a third density signal $X_{13}$ is formed in which density fluctuations with periods $T_1$ and $T_2$ are reduced relative to the first density signal $X_{11}$ and the second density signal $X_{12}$ as shown in FIG. 20, for example. In other words, a density fluctuation correction is performed with a method in FIG. 19 to obtain an image with a high image quality on the intermediate transfer belt 17, in which image density fluctuations with the period $T_1$ and period $T_2$ are reduced.

While an example of performing a density correction only with sub-shading data (the second correction signal $Y_{12}$) is shown, in practice, the sub-shading data (the second correction signal $Y_{12}$) are multiplied with a light amount control signal A (main shading data) to generate a light amount control signal B (main shading data+ sub-shading data). Then, the light amount control signal B may be input to the light source driving apparatus 13 to control a light amount signal of the light source 14 to reduce the respective density fluctuations in the main scanning direction and the sub-scanning direction by a light control amount of the light source 14.

Figure 22A:
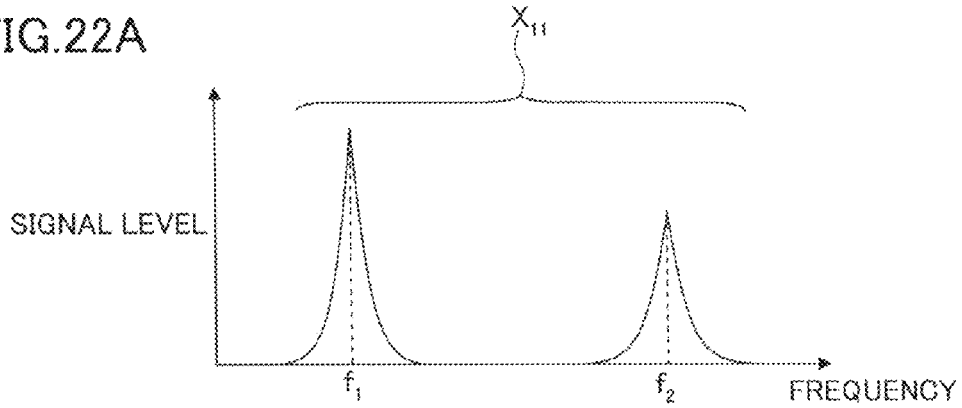
FIGS. 22A to 22D are diagrams exemplifying a behavior in the frequency domain of various signals shown in FIG. 20.

FIG. 22A to 22D are diagrams exemplifying a behavior in the frequency domain of various signals shown in FIG. 20. In FIG. 22A to 22D, the horizontal axis shows frequency, while the vertical axis shows a signal level. FIG. 22A shows a frequency distribution of the first density signal $X_{11}$ shown in FIG. 20. As shown in FIG. 22A, for the first density signal $X_{11}$ is seen a frequency distribution with a frequency $f_1$ and a frequency $f_2$ as centers, which frequency $f_1$ corresponds to a period $T_1$, which is a rotational period of the drum 16, which frequency $f_2$ corresponds to a period $T_2$, which is a rotational period of the developing roller 22.

Figure 22B:
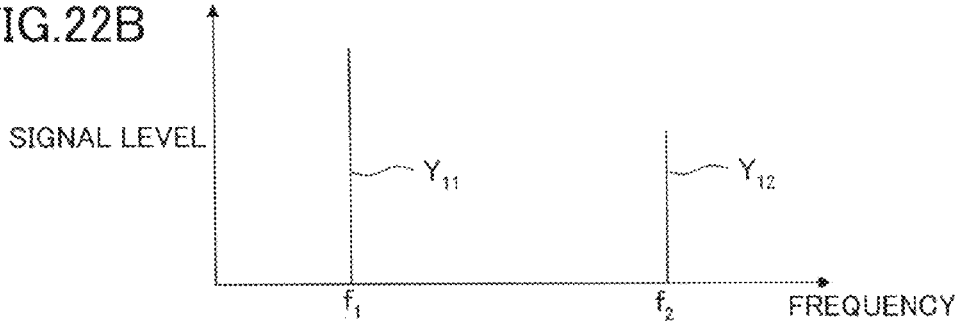

FIG. 22B shows respective frequency distributions of the first correction signal $Y_{11}$ and the second correction signal $Y_{12}$ shown in FIG. 20. The first correction signal $Y_{11}$ and the second correction signal $Y_{12}$ are respectively generated as sinusoidal signals, so that, as shown in FIG. 22B, they indicate frequency distributions of only a frequency $f_1$ which corresponds to a period $T_1$ and a frequency $f_2$ which corresponds to a period $T_2$.

Figure 22C:
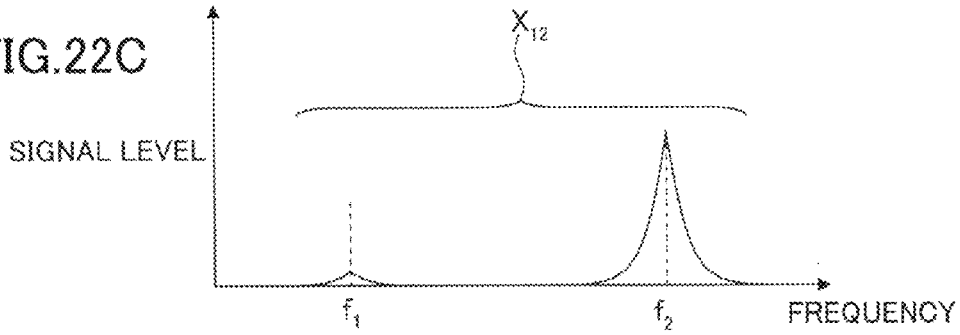

FIG. 22C shows a frequency distribution of the second density signal $X_{12}$ shown in FIG. 20. As shown in FIG. 22C, in the second density signal $X_{12}$, the first density signal $X_{11}$ is already corrected for with the first correction signal $Y_{11}$, so that, in comparison to FIG. 22A, a frequency component with a frequency $f_1$ as a center decreases and only a frequency component with a frequency $f_2$ as a center appears prominently.

Figure 22D:
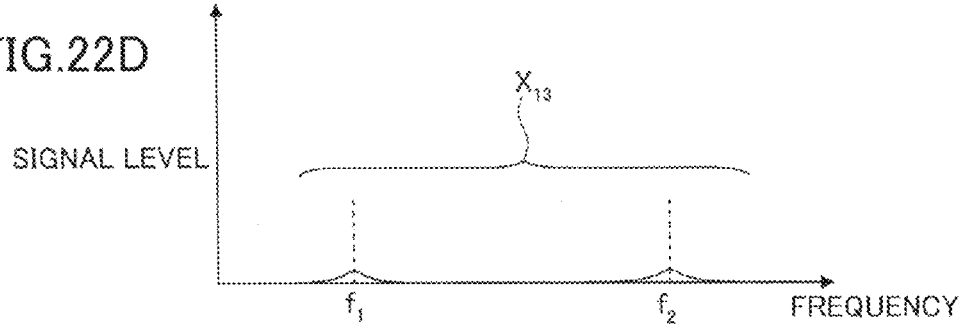

FIG. 22D shows a frequency distribution of the third density signal $X_{13}$ shown in FIG. 20. As shown in FIG. 22D, in the third density signal $X_{13}$, a frequency component with the frequency $f_2$ as a center decreases in comparison to FIG. 22C since the second density signal $X_{12}$ is already corrected for with the second correction signal $Y_{12}$. In other words, compared to FIG. 22A, frequency components with the frequency $f_1$ and the frequency $f_2$ decrease.

In this way, frequency components of both the frequency $f_1$ which corresponds to the period $T_1$, which is a rotational period of the drum 16, and the frequency $f_2$ which corresponds to the period $T_2$, which is a rotational period of the developing roller 22, may be corrected for dynamically to reduce density fluctuations which occur periodically. In other words, for density fluctuations which occur due to fluctuations in a physical position between the drum 16 and the developing roller 22, accurate density signals for density fluctuation correction can be obtained, so that an image forming apparatus which can reduce density fluctuations may be realized in a simple configuration.

Moreover, as the density fluctuation detecting patterns which detect two signals are generated simultaneously, a one time density detecting time becomes shorter in comparison to a case in which the density fluctuation detecting patterns for detecting two types of periodic signals that correspond to different home position signals are generated, so that a waiting time, etc. is reduced.

Fifth Embodiment

In a fifth embodiment, an example is shown of detecting the density fluctuation detecting patterns 23 and 24 by one density sensor.

Figure 23:
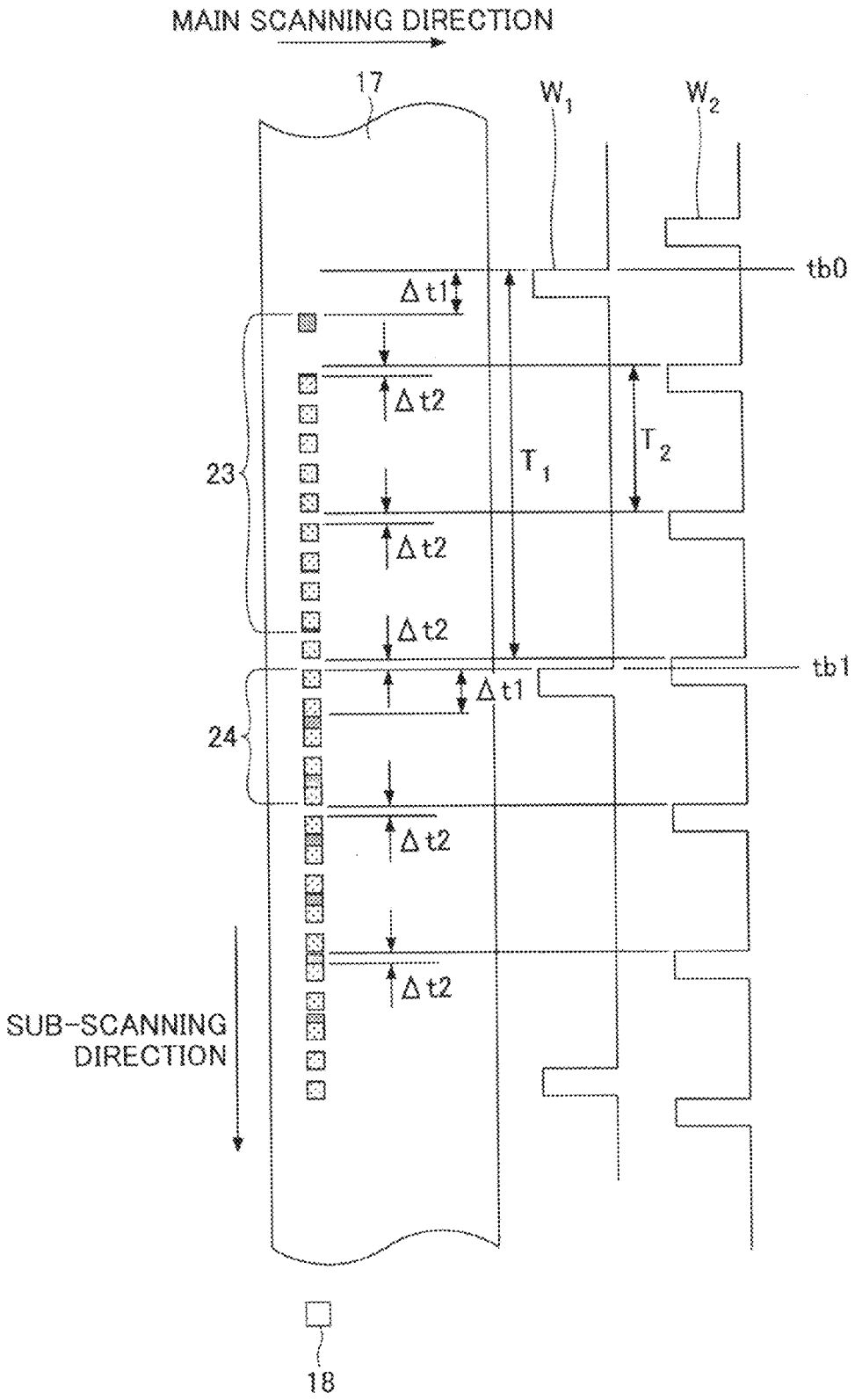
FIG. 23 is a diagram exemplifying a density fluctuation detecting pattern according to a fifth embodiment.
Figure 24:
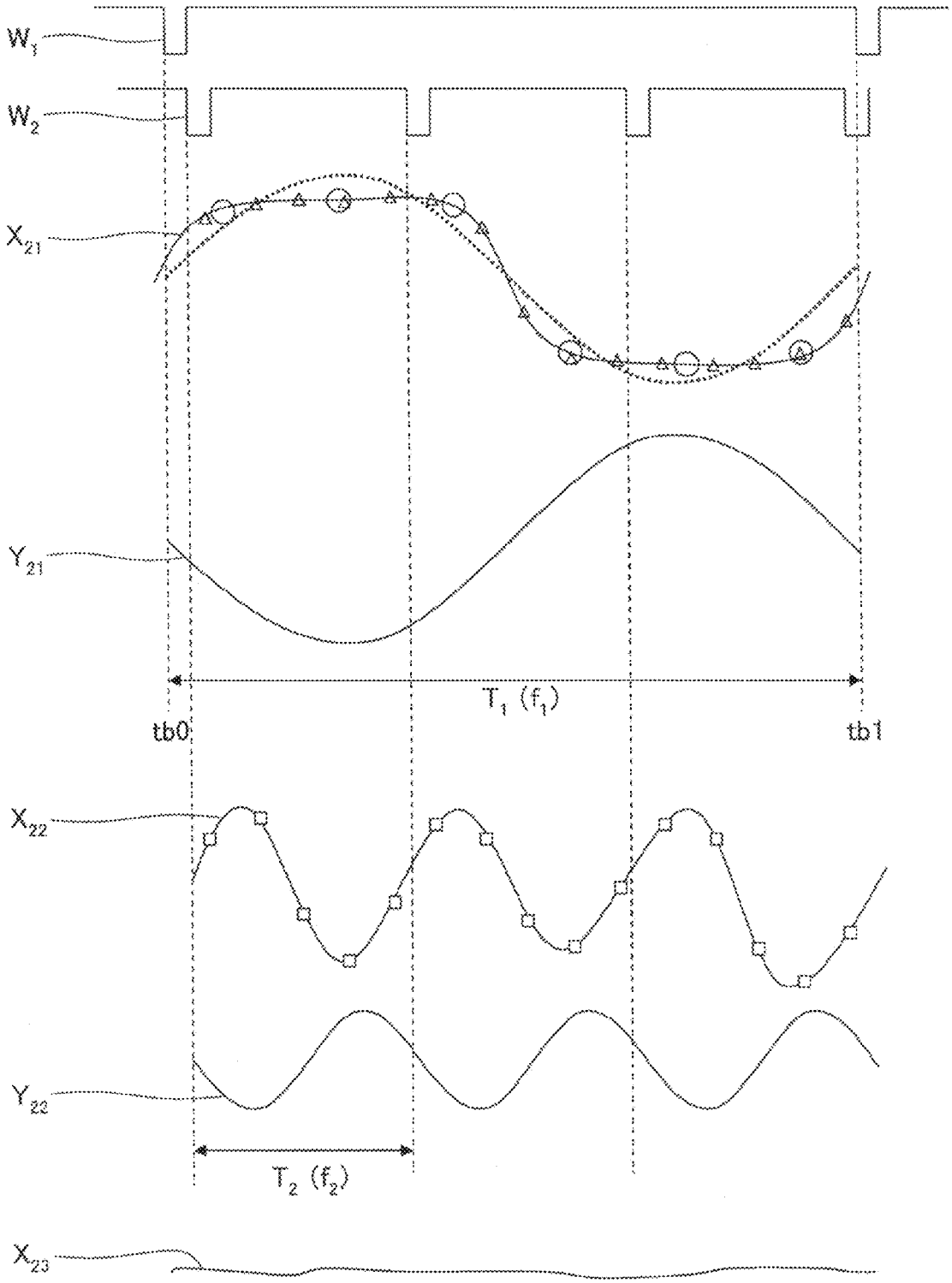
FIG. 24 is a diagram exemplifying various signals related to density fluctuation correction according to the fifth embodiment.

FIG. 23 is a diagram exemplifying a density fluctuation detecting pattern according to the fifth embodiment. FIG. 24 is a diagram exemplifying various signals related to the density fluctuation correction according to the fifth embodiment. With reference to FIG. 23, on the intermediate transfer belt 17, the density fluctuation detecting patterns 23 and 24 for detecting density fluctuations are formed on the same straight line relative to a conveying direction of the intermediate transfer belt 17 such that a part of each overlaps the other. According to the fifth embodiment, the density fluctuation detecting patterns 23 and 24 are detected by only one density sensor 18.

In the density fluctuation correction according to the fifth embodiment, steps S101 to S107 in FIG. 19 are exactly the same as in the density fluctuation correction according to the fourth embodiment. In step S108, it is different from the fourth embodiment in that the density fluctuation detecting pattern 24 is formed on the same straight line relative to a conveying direction of the intermediate transfer belt 17 such that it overlaps a part of the density fluctuation detecting pattern 23.

In step S109, unlike in the fourth embodiment, one density sensor 18 simultaneously detects the density fluctuation detecting patterns 23 and 24 formed such that a part of each overlaps the other, so that a density signal $X_{21}$ as shown in FIG. 24, for example, is output. The density signal $X_{21}$ is a signal which includes information on density fluctuations in a conveying direction of the intermediate transfer belt 17.

Here, when the period $T_1$ of the HP signal $W_1$> the period $T_2$ of the HP signal $W_2$ (when the frequency $f_1$ of the HP signal $W_1$< the frequency $f_2$ of the HP signal $W_2$), as seen from the density signal $X_{21}$, it is difficult to discriminate the density fluctuation with the period $T_2$.

Then, the first correction signal generating unit 30*d* generates a correction signal $Y_{21}$ (frequency $f_1$) by causing data shown with a circle for the density signal $X_{21}$ (data corresponding to the density fluctuation detecting pattern 23) to undergo an FFT (fast Fourier transform), etc. Then, the correction signal $Y_{21}$ is multiplied by the density signal $X_{21}$ to obtain a second density signal $X_{22}$, in which density fluctuations with the period $T_1$ are reduced. In the obtained second density signal $X_{22}$, a density fluctuation component of a period $T_1$ is reduced, so that a tendency of density fluctuations with the period $T_2$ appears.

Next, in step S110, the second correction signal generating unit 30*e* generates a second correction signal $Y_{22}$ (a signal with a period $T_2$ and a frequency $f_2$), which is a sinusoidal signal with a phase which is reverse that of density fluctuations as shown in FIG. 24, for example, based on a second density signal $X_{22}$. Next, in step S111, the second correction signal generating unit 30*e* causes a value of the second correction signal $Y_{22}$ generated in step S110 to undergo A/D conversion, for example, to hold the converted result in a memory (not shown), etc.

Thereafter, the second correction signal $Y_{22}$, which is held in the memory (not shown), etc., may be input into the light source driving apparatus 13 to control a light amount signal of the light source 14 to form density fluctuation detecting patterns in which density fluctuations with periods $T_1$ and $T_2$ are reduced. When the density fluctuation detecting pattern which is corrected for with the second correction signal $Y_{22}$ is detected by the density sensor, a third density signal $X_{23}$ is obtained in which density fluctuations with periods $T_1$ and $T_2$ are reduced as shown in FIG. 24. In other words, a density fluctuation correction is performed with a method in FIG. 19 to obtain a high quality image on the intermediate transfer belt 17, in which image density fluctuations with the period $T_1$ and period $T_2$ are reduced.

In this way, in the fifth embodiment, the same advantages are yielded as in the fourth embodiment; as one density sensor 18 detects density fluctuation detecting patterns 23 and 24, which are formed such that a part of each pattern overlaps the other, a number of parts of the density sensor in the image forming apparatus may be reduced, contributing to a decreased cost.

Sixth Embodiment

In the sixth embodiment, an example is shown of detecting the density fluctuation detecting patterns 24 only by one density sensor.

In the density fluctuation correction according to the sixth embodiment, steps S101 to S103 in FIG. 19 are exactly the same as in the density fluctuation correction according to the fourth embodiment. In step S104, the second pattern forming unit 30*c* forms a density fluctuation detecting pattern 24 (a second density fluctuation detecting pattern) as shown in FIG. 18, for example, in a position corresponding to the density sensor 18*a* on the intermediate transfer belt 17 along a conveying direction of the intermediate transfer belt 17.

Figure 25:
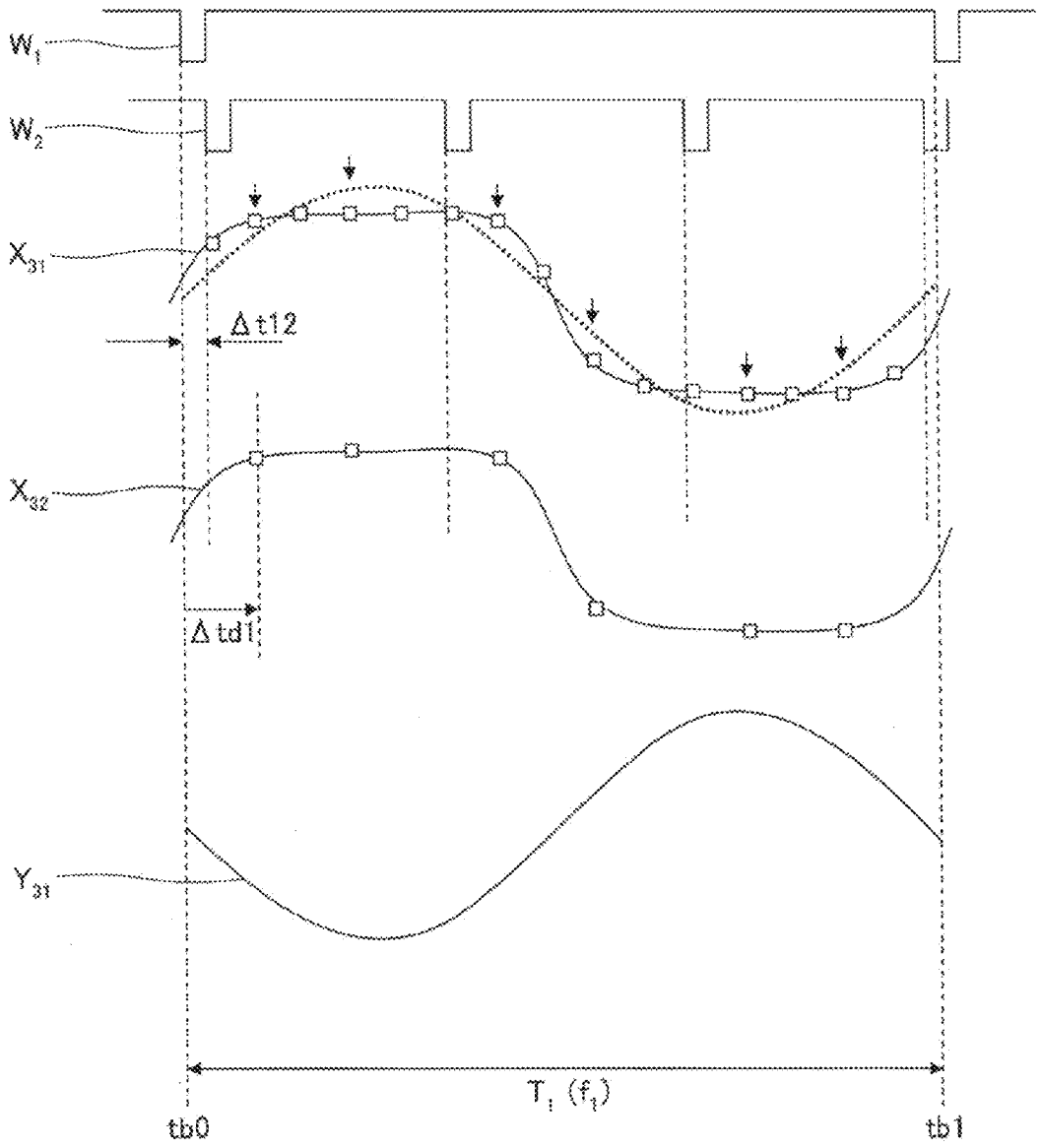
FIG. 25 is a diagram exemplifying various signals related to density fluctuation correction according to a sixth embodiment.

Next, in step S105, the density sensor 18 detects a density fluctuation detecting pattern 24 and outputs a density signal $X_{31}$, which is synchronized to the period $T_2$ of the HP signal $W_2$ as shown in FIG. 25, for example. The density signal $X_{31}$ is a signal which includes information on density fluctuations with periods $T_1$ and $T_2$ in the conveying direction of the intermediate transfer belt 17. Here, the first correction signal generating unit 30*d* samples a number of points in the density signal $X_{31}$ at predetermined timings and generates a first density signal $X_{32}$ corresponding to the HP signal $W_1$ from the sampled signal.

Next, in step S106, the first correction signal generating unit 30*d* generates a first correction signal $Y_{31}$ (a signal with a period $T_1$ and a frequency $f_1$), which is a sinusoidal signal with a phase which is reverse that of density fluctuations as shown in FIG. 25, for example, based on a first density signal $X_{32}$. Next, in step S107, the first correction signal generating unit 30*d* causes a value of the first correction signal $Y_{31}$ generated in step S106 to undergo A/D conversion, for example, to hold the converted result in a memory (not shown), etc. Next, the same process as in steps S108-S111 according to the fourth embodiment is executed. In this way, the same advantageous effect as in the fourth embodiment is obtained.

The HP signal $W_2$ relative to the HP signal $W_1$ is a non-synchronous signal, so that, a delay time of, for example, Δtd1, occurs for the density fluctuation detecting pattern 24 for which writing is started at a timing of the HP signal $W_2$ relative to the HP signal $W_1$. Then, the delay time of Δt12 between the HP signal $W_1$ and the HP signal $W_2$ may be detected to calculate a timing, relative to the HP signal $W_1$, at which writing of the density fluctuation detecting pattern 24 is started. Thus, a phase difference of the density fluctuation signals may be detected, making it possible to accurately calculate density fluctuations with the period $T_1$ of the HP signal $W_1$.

In this way, even a method of forming only the density fluctuation detecting pattern 24 corresponding to a shorter period $T_2$ twice may be used to reduce density fluctuations with periods $T_1$ and $T_2$.

Moreover, multiple density detections may be performed with one density fluctuation detecting pattern without a need to have multiple types of density fluctuation detecting patterns to realize a reduced size and cost of circuitry in the image forming apparatus.

Seventh Embodiment

In a seventh embodiment, an example is shown of forming a set of density fluctuation detecting patterns 23 and 24 in multiple numbers.

Figure 26:
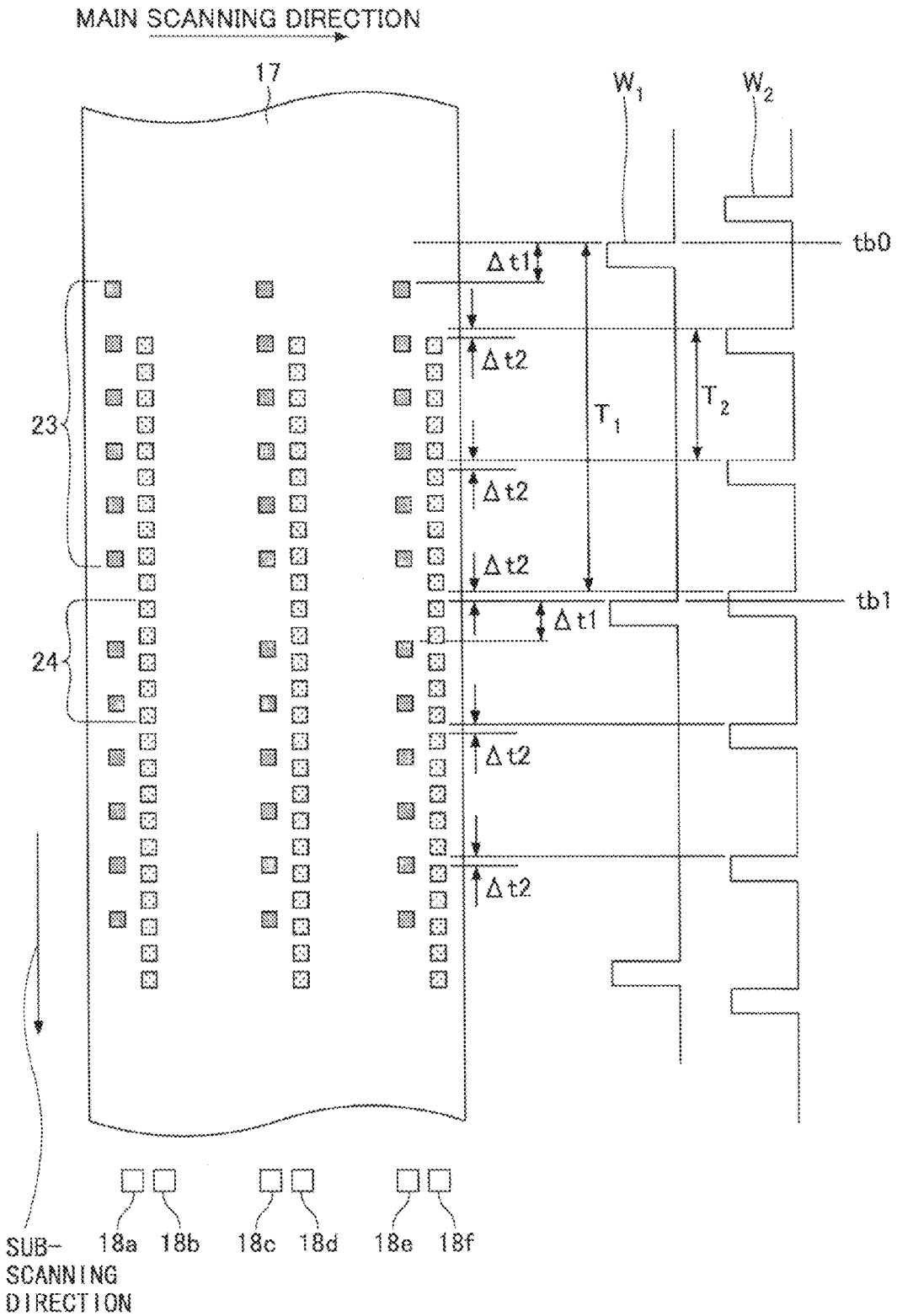
FIG. 26 is a diagram illustrating a first part of a diagram exemplifying a density fluctuation detecting pattern according to a seventh embodiment.

FIG. 26 is a first part of a diagram exemplifying a density fluctuation detecting pattern according to the seventh embodiment. With reference to FIG. 26, on the intermediate transfer belt 17, sets of density fluctuation detecting patterns 23 and 24 shown in FIG. 18 are formed in multiple numbers at different positions in the vertical direction (the main scanning direction) relative to the conveying direction of the intermediate transfer belt 17. Moreover, the density sensors 18*a* to 18*f* are arranged at positions corresponding to the respective density fluctuation detecting patterns.

In this way, the sets of density fluctuation detecting patterns 23 and 24 are formed in multiple numbers at different positions in the vertical direction (the main scanning direction) relative to the conveying direction of the intermediate transfer belt 17 to obtain density signals by the corresponding density sensors, so that information on density fluctuations within a face in one round of the developing roller 22 and the drum 16 is obtained. As a result, an average value of density fluctuation detecting signals obtained at multiple positions in the main scanning direction on the intermediate transfer belt 17 may be taken, etc., to obtain information on average density fluctuations within the face and also to realize accurate density fluctuation detection and density fluctuation correction.

Figure 27:
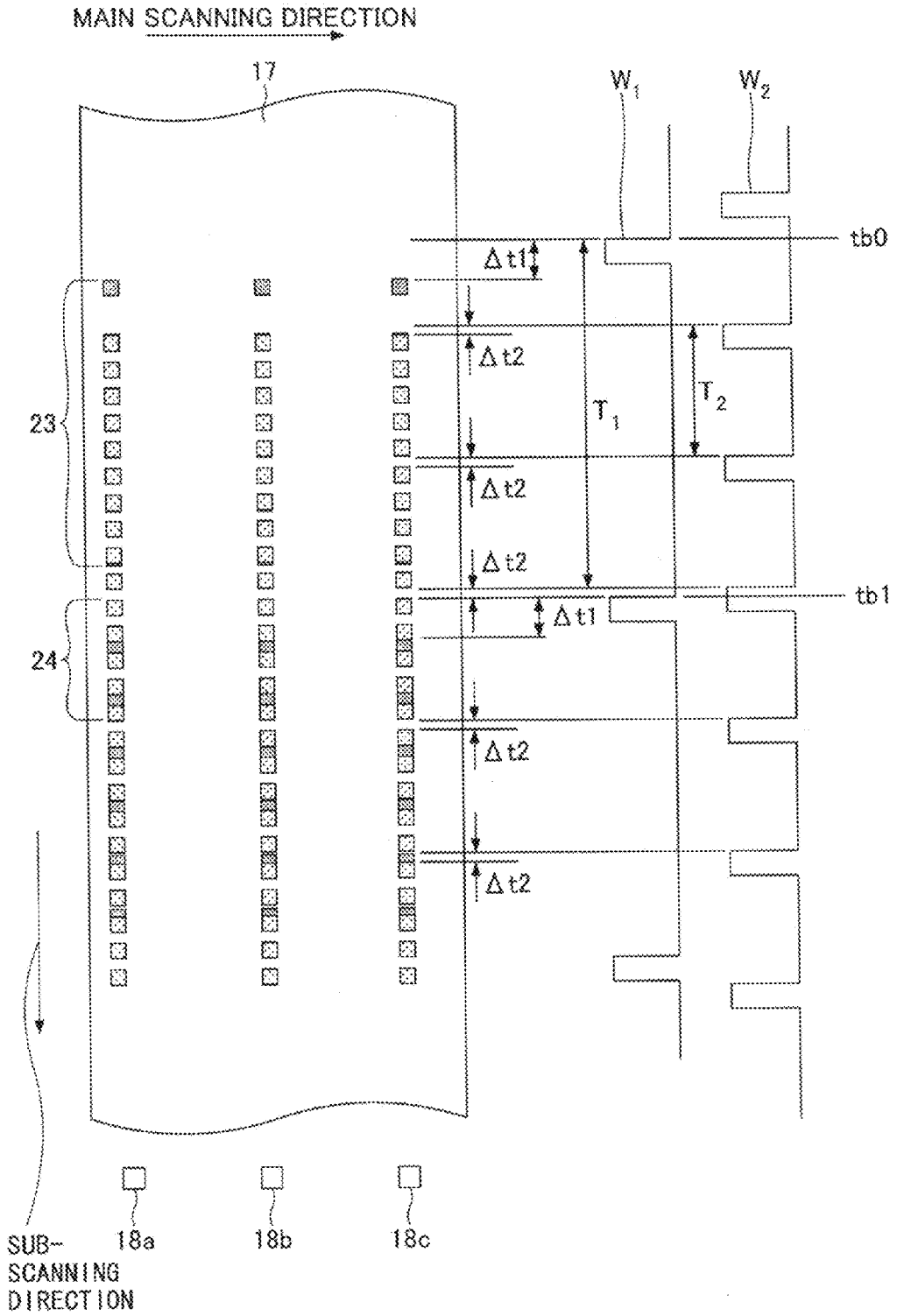
FIG. 27 is a diagram illustrating a second part of the diagram exemplifying the density fluctuation detecting pattern according to the seventh embodiment.

FIG. 27 is a second part of the diagram exemplifying the density fluctuation detecting pattern according to the seventh embodiment. As shown in FIG. 27, sets of density fluctuation detecting patterns 23 and 24 shown in FIG. 23 may be formed in multiple numbers at different positions in the orthogonal direction (the main scanning direction) relative to the conveying direction of the intermediate transfer belt 17, while arranging density sensors 18*a*-18*c* at positions corresponding to the density fluctuation detecting patterns. Even in this way, the same advantageous effect as in FIG. 26 is obtained.

While preferred embodiments have been described in the above in detail, they are not limited to the above-described embodiments, so that various changes and modifications may be added to the above-described embodiments without departing from the scope recited in the claims.

For example, for an image forming apparatus having multiple developing rollers, an HP sensor corresponding to a drum and multiple HP sensors corresponding to each of the multiple developing rollers may be used to perform density correction. In other words, n HP sensors may be used to correct for density fluctuations with n periods.

Moreover, in lieu of a method of changing a light amount of a light source as a scheme of correcting for density fluctuations, a method of changing a developing bias of the developing roller, etc., may be used.

The present application is based on Japanese Priority Applications No. 2012-061245 and 2012-061246, which were filed on Mar. 16, 2012, the entire contents of which are hereby incorporated by reference.

The invention claimed is:

1. An image forming apparatus, comprising:

a light source;

a drum which is a photosensitive body;

an optical scanning apparatus which deflects and scans, in a main scanning direction by a deflecting and scanning unit, a light beam emitted from the light source, and collects, by a scanning and image forming unit, the deflected and scanned light beam onto the drum, which drum has a face to be scanned, to form a latent image onto a surface of the drum; and an endless belt which is arranged to be in contact with the drum and on which an image corresponding to the latent image is formed, the image forming apparatus further including a pattern forming unit which forms, on the endless belt along a conveying direction of the endless belt, a density fluctuation detecting pattern having a period;

a density sensor which detects the density fluctuating detecting pattern and outputs a density signal including information on density fluctuations in the conveying direction of the endless belt; and a period detecting sensor which detects the period included in the density fluctuations, wherein the pattern forming unit forms, on the endless belt, the density fluctuation detecting pattern with an image area rate between 50% and 85%.

2. The image forming apparatus as claimed in claim 1, further comprising:

a rotating body which is arranged to oppose the drum, wherein the density fluctuation detecting pattern includes a first density fluctuation detecting pattern having a first occurrence period and a second density fluctuation detecting pattern having a second occurrence period which is different from the first occurrence period, and wherein the pattern forming unit includes a first pattern forming unit which forms the first density fluctuation detecting pattern and a second pattern forming unit which forms the second density fluctuation detecting pattern, and wherein the period detecting sensor includes a first period detecting sensor which detects density fluctuations with a first period which corresponds to rotating of the drum and a second period detecting sensor which detects density fluctuations with a second period corresponding to rotating of the rotating body that differ from a rotational period of the drum.

3. The image forming apparatus as claimed in claim 2, further comprising:

a first correction signal generating unit which generates a first correction signal with the first period based on the density signal; and a second correction signal generating unit which generates a second correction signal with the second period based on the density signal.

4. The image forming apparatus as claimed in claim 3, wherein the first pattern forming unit and the second pattern forming unit form the first density fluctuation detecting pattern and the second density fluctuation detecting pattern on a same straight line relative to the conveying direction of the endless belt such that a part of the first pattern forming unit and a part of the second pattern forming unit overlap each other.

5. The image forming apparatus as claimed in claim 4, wherein the first correction signal generating unit generates the first correction signal by fast Fourier transform (FFT) based on a density signal which includes information on density fluctuations of both the first density fluctuation detecting pattern and the second density fluctuation detecting pattern.

6. The image forming apparatus as claimed in claim 3, wherein the first period is longer than the second period, and wherein a density signal which includes information on density fluctuations of the second density fluctuation detecting pattern is sampled with the first occurrence period to generate a density signal corresponding to the first density fluctuation detecting pattern.

7. The image forming apparatus as claimed in claim 3, wherein the density sensor includes a first density sensor and a second density sensor, wherein the first pattern forming unit and the second pattern forming unit form the respective first and second density fluctuation detecting patterns at different positions in a direction orthogonal to the conveying direction of the endless belt, wherein the first density sensor detects the first density fluctuation detecting pattern to output a first density signal which includes information on density fluctuations in the conveying direction of the endless belt, and wherein the second density sensor detects the second density fluctuation detecting pattern to output a second density signal which includes information on density fluctuations in the conveying direction of the endless belt.

8. The image forming apparatus as claimed in claim 7, wherein the first period is longer than the second period, wherein the second pattern forming unit forms the second density fluctuation detecting pattern while the first density signal is corrected for using the first correction signal, wherein the second density sensor detects the second density fluctuation detecting pattern which is formed while the first density signal is corrected for to output the second density signal, and wherein the second correction signal generating unit generates the second correction signal from the second density signal based on the second density fluctuation detecting pattern formed while the first density signal is corrected for.

9. The image forming apparatus as claimed in claim 2, wherein a pattern interval of the second density fluctuation detecting pattern is a constant interval over multiple periods of the second period.

10. The image forming apparatus as claimed in claim 2, wherein the rotating body is a developing roller for developing a latent image formed on the drum.

11. The image forming apparatus as claimed in claim 1, further comprising:

a correction signal generating unit which generates a correction signal for correcting for exposure power of the light source such that the density fluctuations are reduced based on an output signal of the density sensor.

12. The image forming apparatus as claimed in claim 11, further comprising:

the period detecting sensor which detects a rotational period of the drum, wherein the pattern forming unit forms the density fluctuation detecting pattern with the rotational period of the drum detected by the period detecting sensor.

13. The image forming apparatus as claimed in claim 11, further comprising:

a calibrating unit which forms, on the endless belt, a density calibrating pattern for calculating a change amount of a density relative to light amount fluctuations of the light source, wherein the calibrating unit forms the density calibrating pattern with exposure power of three or more levels that are changed by controlling exposure power of the light source and at the image area rate between 50% and 85%.

14. The image forming apparatus as claimed in claim 11, wherein the density sensor includes multiple density sensors arranged in parallel in the main scanning direction, and wherein the correction signal generating unit generates a correction formula which corrects for density fluctuations in the main scanning direction based on an output signal of each density sensor and a position of each density sensor.

15. The image forming apparatus as claimed in claim 11, wherein the density sensor includes multiple density sensors arranged in parallel in the main scanning direction, and wherein the correction signal generating unit generates a correction signal which corrects for density fluctuations in a sub-scanning direction which is orthogonal to the main scanning direction based on an output signal of the period detecting sensor and an output signal of at least one density sensor of the multiple density sensors.

16. The image forming apparatus as claimed in claim 11, wherein the correction signal is a sinusoidal periodic pattern.

17. The image forming apparatus as claimed in claim 11, wherein the correction signal is a triangular periodic pattern.

18. The image forming apparatus as claimed in claim 11, wherein the correction signal is a trapezoidal periodic pattern.

19. The image forming apparatus as claimed in claim 1, wherein the pattern forming unit forms the density fluctuation detecting pattern corresponding to multiple rotational periods of the drum that are detected by the period detecting sensor.

20. The image forming apparatus as claimed in claim 1, wherein the light source is a surface emitting laser.

* * * * *